US007766084B2

(12) United States Patent
Churchill

(10) Patent No.: US 7,766,084 B2
(45) Date of Patent: Aug. 3, 2010

(54) DOWNHOLE TOOL

(75) Inventor: Andrew Phillip Churchill, Aberdeen (GB)

(73) Assignee: Churchill Drilling Tools Limited, Aberdeen, Scotland (GB)

( * ) Notice: Subject to any disclaimer, the term of this patent is extended or adjusted under 35 U.S.C. 154(b) by 243 days.

(21) Appl. No.: 10/595,878

(22) PCT Filed: Nov. 17, 2004

(86) PCT No.: PCT/GB2004/004852

§ 371 (c)(1),
(2), (4) Date: Nov. 20, 2006

(87) PCT Pub. No.: WO2005/049960

PCT Pub. Date: Jun. 2, 2005

(65) Prior Publication Data

US 2007/0181313 A1 Aug. 9, 2007

(30) Foreign Application Priority Data

Nov. 17, 2003 (GB) ..... 0326867.9
Feb. 10, 2004 (GB) ..... 0402858.5

(51) Int. Cl.
*E21B 34/10* (2006.01)

(52) U.S. Cl. ..... 166/320; 137/115.03

(58) Field of Classification Search ..... 166/332.1, 166/332.4, 320, 321; 137/115.03, 115.09, 137/504

See application file for complete search history.

(56) References Cited

U.S. PATENT DOCUMENTS

| | | | | |
|---|---|---|---|---|
| 3,757,816 | A * | 9/1973 | Price | 137/498 |
| 4,298,077 | A | 11/1981 | Emery | |
| 4,817,739 | A | 4/1989 | Jeter | |
| 4,905,775 | A * | 3/1990 | Warren et al. | 175/38 |
| 4,938,397 | A | 6/1990 | McDonald et al. | |
| 5,443,129 | A | 8/1995 | Bailey et al. | |
| 5,499,687 | A | 3/1996 | Lee | |
| 5,609,178 | A | 3/1997 | Hennig et al. | |
| 5,890,540 | A | 4/1999 | Pia et al. | |
| 5,901,796 | A | 5/1999 | McDonald | |
| 6,488,092 | B1 * | 12/2002 | Schoeffler | 166/320 |
| 6,854,953 | B2 * | 2/2005 | Van Drentham-Susman et al. | 415/36 |
| 2003/0116320 | A1 * | 6/2003 | Szarka et al. | 166/291 |

FOREIGN PATENT DOCUMENTS

| | | |
|---|---|---|
| WO | WO 96/30621 | 10/1996 |
| WO | WO 01/06086 | 1/2001 |

OTHER PUBLICATIONS

International Search Report for Application No. PCT/GB2004/004852, dated Mar. 3, 2005.

* cited by examiner

*Primary Examiner*—Daniel P Stephenson
(74) *Attorney, Agent, or Firm*—Patterson & Sheridan, L.L.P.

(57) ABSTRACT

A downhole tool (10) comprises a body (12) defining a bore. The body includes a valve arrangement (18) including flow ports (24) in the wall of the body. The ports may be opened or closed. In addition, a variable flow restriction (30) is provided in the bore (14), the degree of restriction tending to decrease as flow across the restriction increases. The variable flow restriction may be utilized to actuate the valve arrangement.

28 Claims, 18 Drawing Sheets

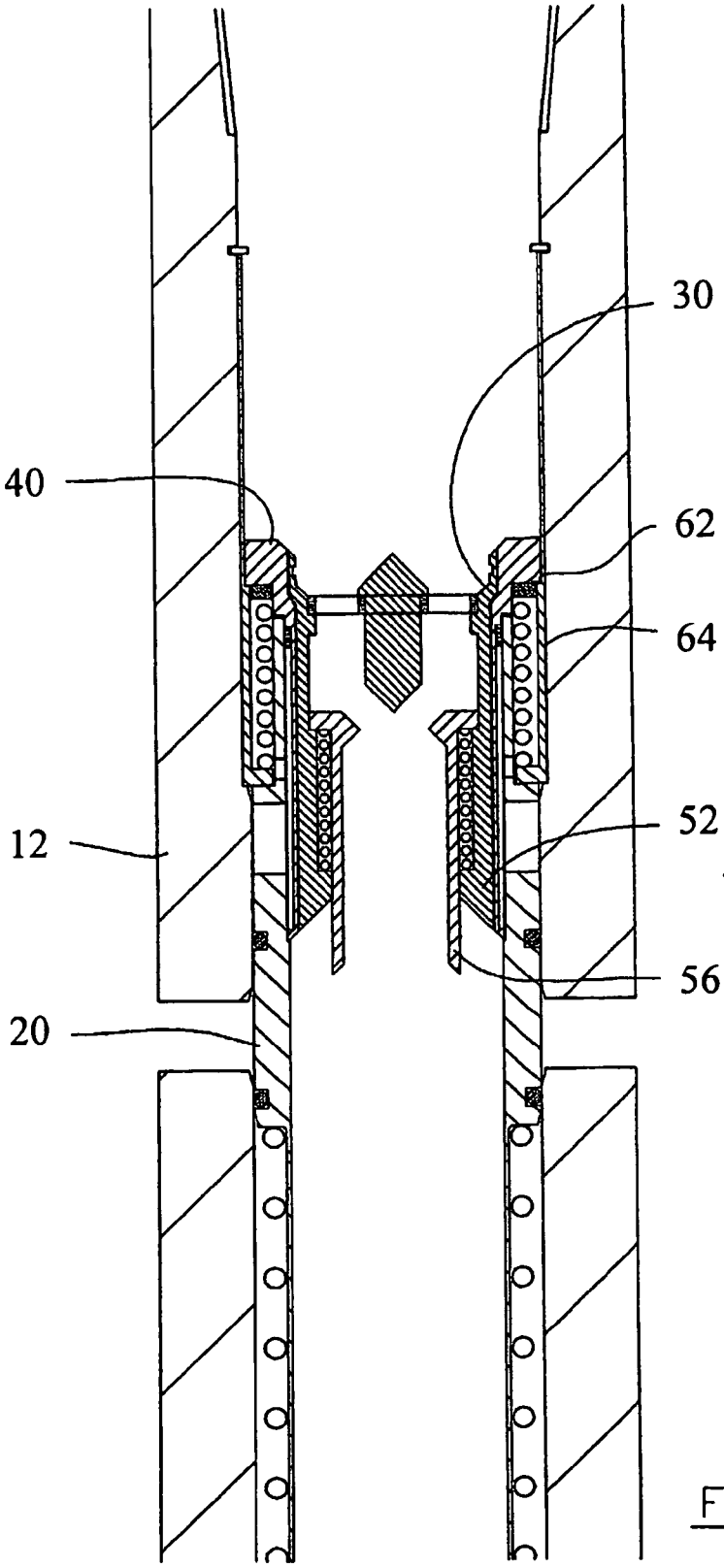
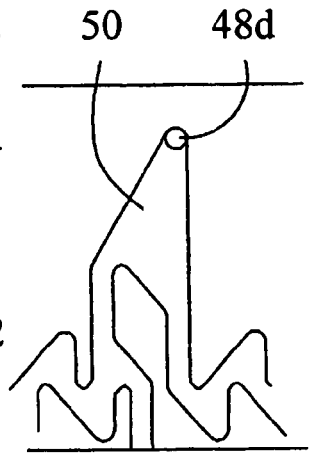
Figure 7b
Figure 7a

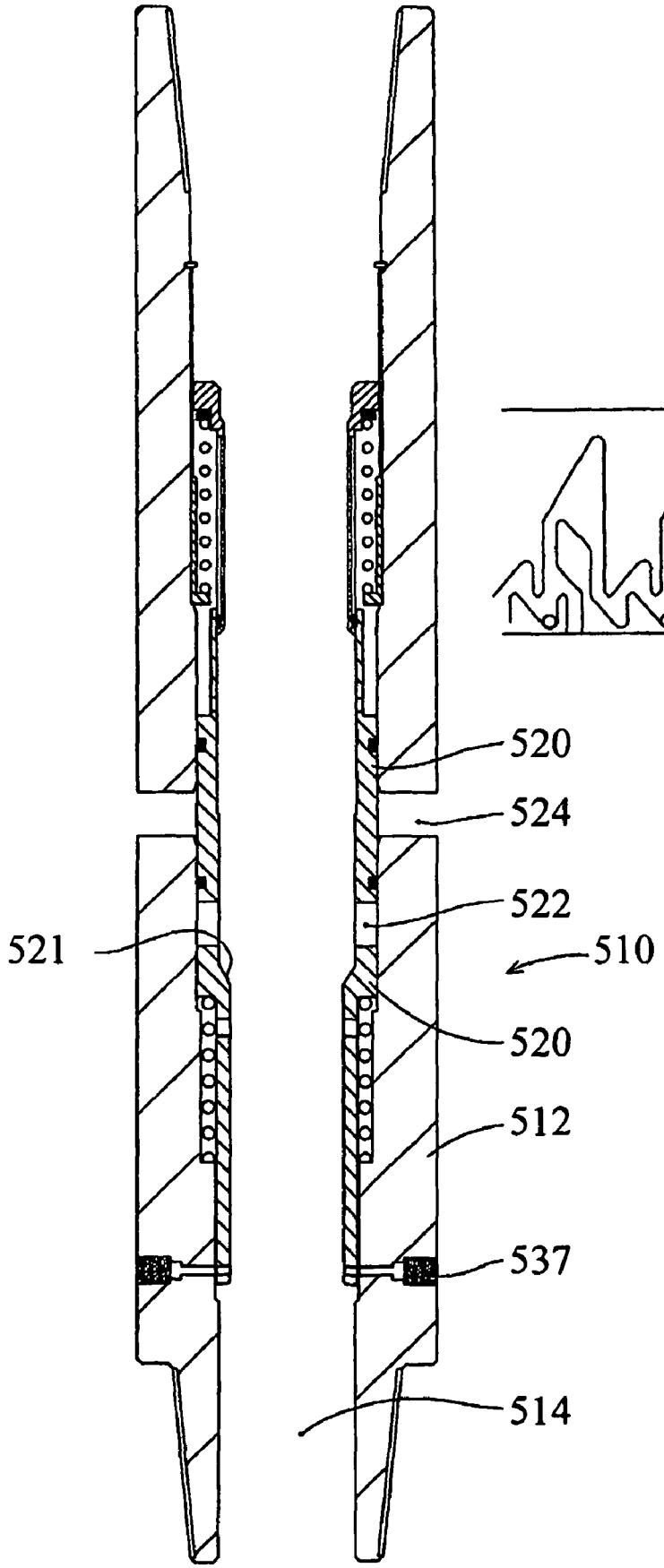
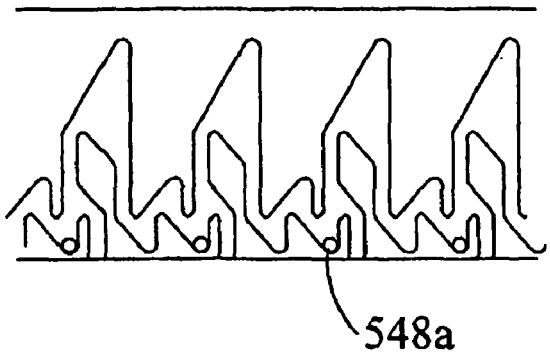
Figure 11b
Figure 11a

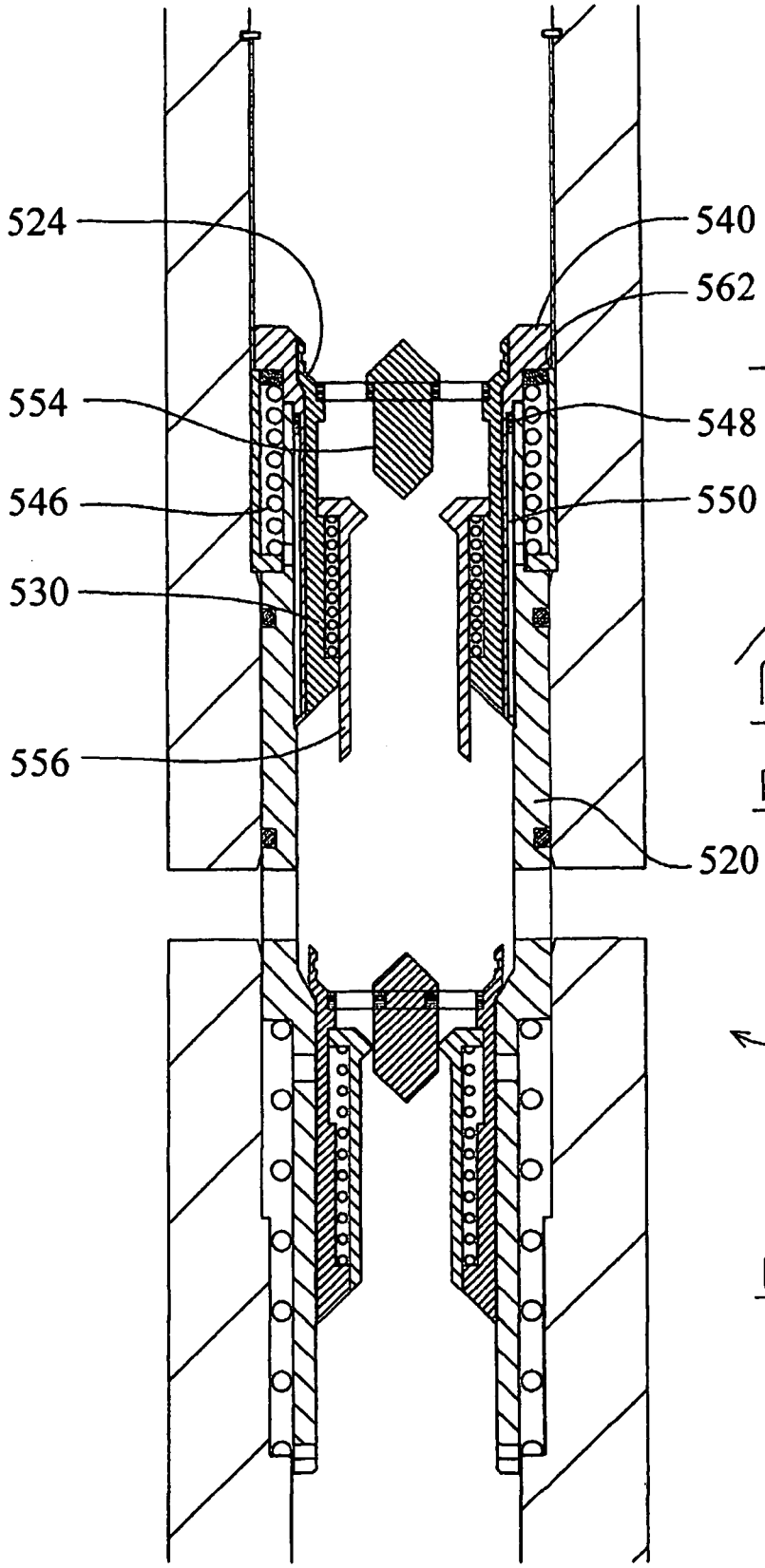
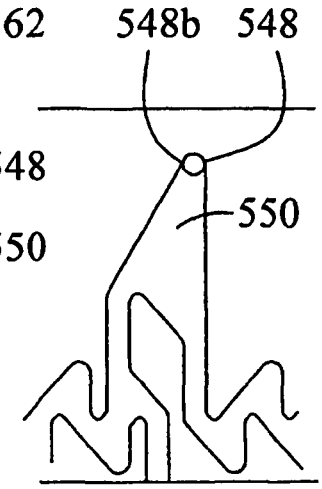
Figure 14b
Figure 14a

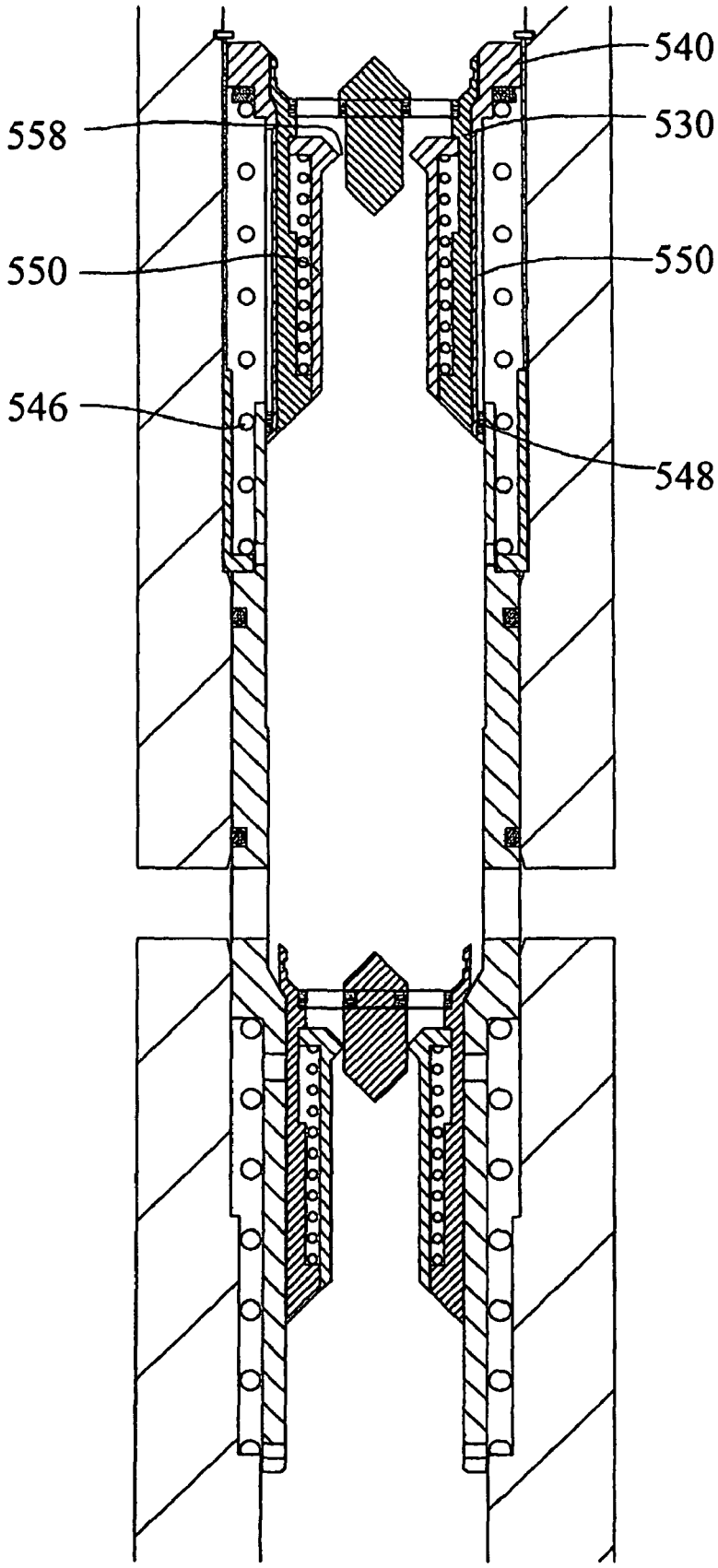
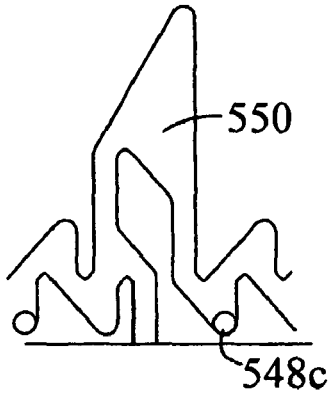
Figure 15b
Figure 15a

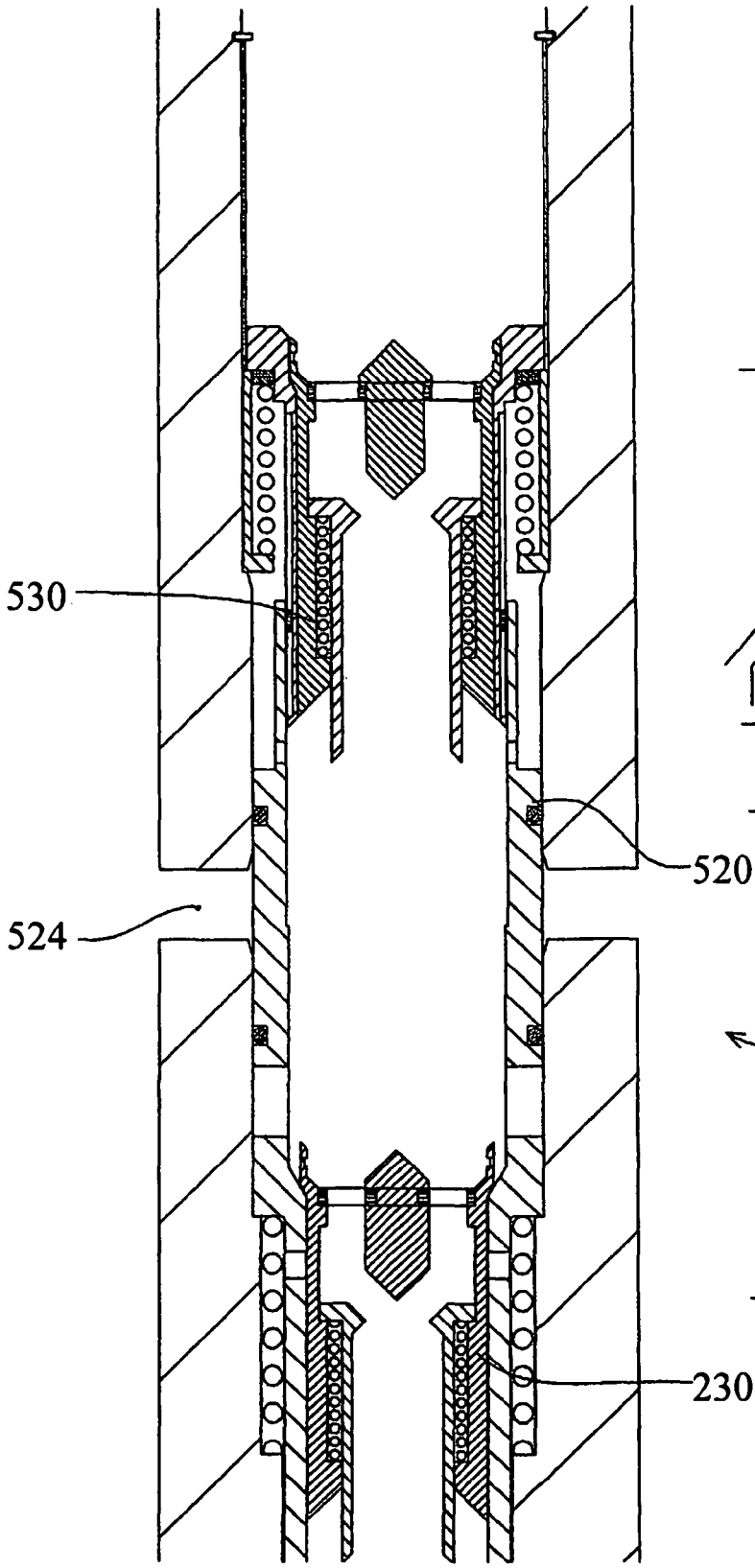
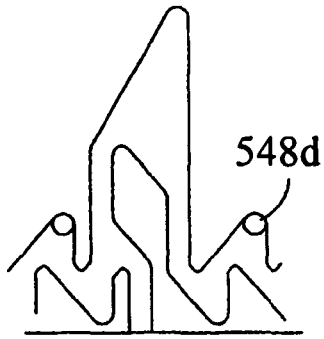
Figure 16b
Figure 16a

DOWNHOLE TOOL

FIELD OF THE INVENTION

This invention relates to a downhole tool, and embodiments of the invention relate to a flow-actuated downhole tool, most typically a bypass tool.

BACKGROUND OF THE INVENTION

In the oil and gas industry, bores are drilled from surface to access subsurface hydrocarbon-bearing formations. In such a drilling operation, a drill bit is mounted on the end of a long "string" of pipe sections, and may be rotated from surface or by a motor located adjacent the drill bit. Drilling fluid or "mud" is pumped from surface down through the tubular string, to exit the drill bit via jetting nozzles. The drilling fluid then passes back to surface via the annulus between the drill pipe string and the bore wall. The drilling fluid serves a number of purposes, one being to carry drill cuttings away from the drill bit and then up through the annulus to surface. For a number of reasons, and particularly in highly, deviated or extended reach wells, drill cuttings will sometimes gather in the annulus, restricting the flow of drilling fluid to surface and causing numerous other problems.

One method of clearing drill cuttings from the annulus is to provide one or more bypass tools in the drill string. These tools allow drilling fluid to flow directly into the annulus from an intermediate part of the drill pipe string, without having to pass through the drill bit and other tools normally located towards the end of a drill string, which tools collectively form a bottom hole assembly (BHA). As a result, the fluid entering the annulus via the bypass tool is at higher velocity and is more effective at carrying and clearing the drill cuttings from the annulus. Bypass tools may also be used in other circumstances where it is desirable or necessary to circulate or supply fluid to the annulus without passing the fluid through the BHA.

There have been many proposals to provide fluid actuated bypass tools relying on a differential pressure force created by the flow of fluid through the tool to open the tool, usually by translating a sleeve to permit flow through a number of side or flow ports in the wall of the tool body. In the late 1970's Emery (U.S. Pat. No. 4,298,077) proposed a bypass valve with a flow responsive differential pressure member, a biasing spring and a controlling cam arrangement. Since then there have been many tools proposed along similar lines. However, none of these tools have had widespread general use due to the tools being unreliable in many situations, although there are a few specific applications where some of the tools do work well.

In the late 1980's Lee (U.S. Pat. No. 5,499,687) proposed a tool where the string bore could be completely blocked off to actuate the tool, by dropping a nylon ball from surface to land in a seat and create a piston which is pushed down by fluid pressure above the ball to open the ports against a spring. This situation could then be reversed by dropping a second smaller steel ball which would block off the port allowing the first ball to be squeezed through its seat and the ports to be closed again. This form of tool may be necessary where it is desired to circulate materials, for example lost-circulation material (LCM), that might damage the BHA, or the BHA includes flow actuated tools which it is preferred to have inoperative during the bypass operation. Lee's tool can also be used to assist in carrying and clearing the cuttings from the annulus. Consequently this tool is prolifically used worldwide in a wide array of well bore applications.

In the mid 1990's Davy et al (WO 9630621), Pia et al (U.S. Pat. No. 5,890,540) and MacDonald (U.S. Pat. No. 5,901,796) proposed flow activated bypass tools which can selectively bypass and seal off the through bore below the bypass ports. However, the added complication of sealing off the through bore has made this form of flow activated tool even more technically challenging, and such tools are still not commercially available.

Other than tools adapted to be completely closed by a ball or the like, such as described by Lee, there are two main mechanisms available for creating a flow activated differential pressure in a tool. The first is by providing a fixed flow restriction, usually a sleeve defining a nozzle, inside the tool. The nozzle creates a distinct pressure drop due to the fluid being forced through the narrow throat of the nozzle, and this pressure acts over the cross sectional area of the sleeve and creates a force in the same direction as the flow. The disadvantages of this method are that the presence of the nozzle creates an additional pressure drop in the string and also the nozzle creates a bore restriction within the string, both of which are undesirable. Bailey et al (U.S. Pat. No. 5,443,129) and Hennig et al (U.S. Pat. No. 5,609,178) described tools where fixed flow restrictions in the form of nozzles or rings are used to power bypass tools.

The other mechanism for creating a flow activated differential pressure is to utilise the differential pressure between the inside and the outside of the pipe. This differential pressure acts via a differential piston, which is a common feature in many downhole tools. Such a piston allows the lower external pressure to act on part of the area of the sliding sleeve and the higher internal pressure to act on an opposing part of the sleeve, so creating a pressure differential force that may be utilised to move a valve sleeve. A differential piston can be configured to move in either direction relative to the direction of flow. This mechanism has neither of the major drawbacks of the nozzle method in that it can provide very significant flow related forces without inducing losses in the flowing fluid and without restricting the tool bore.

However, there a number of difficulties and uncertainties associated with the use of differential pistons, as discussed below. In general terms, the pressure at any point in the pipe or annulus is equal to the sum of all of the pressure losses created downstream of that point by the fluid flowing through the remainder of the fluid circulation path; this is known as the backpressure. Different parts of the string will create different degrees of pressure loss, but every element of the fluid flow path will contribute some pressure loss: each length of pipe, each narrowing at a screwed connection, and every piece of equipment that is part of the drill string will create a pressure loss. In general, where the flow area is small the pressure losses will be greatest. Each of these pressure losses will increase exponentially with the flow rate, such that doubling the flow rate quadruples the pressure loss.

Thus, it can be seen that the magnitude of the opening force provided by a differential piston is largely dependent on the geometry of the pipe and hole below the tool which incorporates the piston, and so will be different for every well. However, in addition, and far more significantly, the force created by a differential piston-actuated bypass tool will only exist when the flow ports are closed. The instant the ports open, flow will divert through the ports, and consequently the flow rate will reduce through the string below the tool. If, for example, the flow is split with ¼ continuing to the bit, the differential pressure force produced by the piston will suddenly be $1/16^{th}$ of the force produced the instant before, when the ports were closed. Thus, the port opening force will suddenly be 1/16th of the force required to overcome the spring and open the port: opening the side ports relieves the pressure that powers the movement of the sleeve to open the port, so the sleeve immediately moves to close the ports. Directly the sleeve has closed the ports the differential pressure force will be restored and the sleeve will be moved to open the ports, and so on. However, if the tool is provided with any form of cycling control system the sleeve may shuttle back and forward until stabilising. Clearly, if the sleeve stabilises in the closed position the tool cannot be used as a bypass tool. If the sleeve shuttles to a stable position in which the sleeve is locked open it will not then be possible to close the ports, as there is very little differential pressure available to overcome the spring force and release the sleeve.

Thus, despite the attendant disadvantages, the most effective flow actuated bypass tools tend to include nozzles or other flow restrictions to create a fluid-flow related opening force: see, for example, applicant's WO 01/06086, the disclosure of which is incorporated herein by reference. However, particularly in circumstances where there is an elevated pressure differential between the tool interior and the annulus, such bypass tools often prove difficult to open. Furthermore, in circumstances where it is only possible to achieve a restricted fluid circulation flow rate, and thus a restricted fluid pressure force across the nozzle, it may be difficult to achieve the force necessary to open the bypass tool.

Even where a bypass tool is successfully opened in a high pressure differential situation, there is also often a problem relating to the initial flow of fluid through the tool flow ports: as the tool opens, the high differential pressure will induce a high velocity flow, which may result in erosion of areas of the tool, and the high velocity flow may also wash out the seals adjacent the flow ports, one of which must pass across the flow ports as the tool is opened. In particular, parts of the seals may be displaced and pushed or sucked through the flow ports, such that when the tool subsequently closes the seals are guillotined, rendering the tool useless.

Thus, although flow-operated bypass tools are currently being successfully used by many operators, the wider use of such tools is restricted by a number of limiting operating parameters, primarily differential pressure and available flow rate, and operation beyond these boundaries tends to have a negative effect on tool reliability and dependability. Accordingly, it is among the objectives of embodiments of the present invention to provide bypass tools capable of operating reliably over a wide range of hydrostatic pressures, differential pressures and flow rates. Also, it is an object of an embodiment of the invention to provide a bypass tool which can block flow to the through bore below the ports while the ports are open.

SUMMARY OF THE INVENTION

According to the present invention there is provided a downhole tool comprising:

a body defining a bore and comprising a valve arrangement including at least one flow port in the wall of the body and whereby the port may be selectively opened and closed; and a variable flow restriction in the bore, the degree of restriction tending to decrease as flow across the restriction increases.

The invention also relates to a method of controlling flow between a tubular downhole string and a surrounding annulus, the method comprising:

providing a valve arrangement in a tubular downhole string, the valve arrangement having a flow port providing fluid communication between the string bore and the surrounding annulus and a variable flow restriction for controlling flow below the valve arrangement;

selectively opening and closing the flow port; and increasing the flow rate through the flow restriction to decrease the degree of restriction provided by the flow restriction.

Thus, the tool may be arranged to allow flow through the flow port, such that fluid may flow between the body bore and the tool exterior, or the flow port may be closed. In certain embodiments of the invention the variable flow restriction may be utilised to control fluid flow through the body bore below the ports.

Preferably the tool body is adapted to be incorporated in a string of tubing, such as a string of drill pipe. Thus, during a drilling operation, fluid may be pumped from surface through the drill string, and may be selectively redirected through the flow port. As will be described, the variable flow restriction may be adapted to selectively close the bore below the flow port, such that all of the fluid may be directed through the flow port, or may permit a proportion of the fluid to pass through the bore while a proportion of the fluid is redirected through the flow port. In other embodiments the variable flow restriction may be utilised to create a pressure differential and the resulting force utilised to actuate the valve arrangement.

Preferably, the valve arrangement is biased towards one of an open configuration and a closed configuration. It is generally preferred that, for well control purposes, the flow port is normally closed. However, there are situations in which it is desirable or advantageous for the flow port to be normally open, as will be described. The valve arrangement may be initially retained in one of the open configuration and the closed configuration, and after release may move to the other configuration.

Preferably, the valve arrangement includes control means for at least one of controlling the sequence of operation of the valve arrangement and controlling the response of the valve arrangement to actuation forces. The control means may comprise a cam arrangement between a movable valve element and the body, and may comprise a cam arrangement between a valve actuator and a valve element.

Preferably, the valve arrangement is flow-actuated, and most preferably the valve arrangement is adapted to be actuated by a differential fluid pressure acting across at least one flow restriction in the bore, which flow restriction may be provided by the variable flow restriction or by a further flow restriction, or by a combination of the variable flow restriction and a further flow restriction. The further flow restriction may be a fixed restriction or may be a variable restriction. Thus, the variable flow restriction may operate independently of the valve arrangement or may be operatively associated with the valve arrangement. Where provided, the further flow restriction may be integral with the tool body, or may be provided as a separate unit to be located in the body as and when required.

In other embodiments of the invention the valve arrangement is adapted to be actuated by one or more other means, including but not limited to a spring, which may be a mechanical spring or a fluid spring, an electric motor, weight or tension.

The variable flow restriction may feature a tight configuration in which the restriction completely closes the body bore, or in the tight configuration the flow restriction may still allow flow through the bore. If the variable flow restriction is positioned above or upstream of the flow ports, the former arrangement may be used to prevent flow of fluid through both the bore and the flow port, and if the variable flow restriction is positioned below or downstream of the flow port all of the fluid flowing into the tool may be redirected through the flow port.

The variable flow restriction may be integral with the body or may be provided as a separate unit that may be located in the body when required. The latter arrangement provides the advantage that, if desired, the body may be used substantially without restriction until the unit is located in the body.

Other preferred and alternative features of this first aspect of the invention are also described below with reference to other aspects of the invention.

According to another aspect of the present invention there is provided a downhole tool comprising:

a body defining a bore and comprising a valve arrangement including a flow port in the wall of the body and a valve element positionable to close the flow port and wherein the valve element is biased towards a position to open the port; and valve element retaining means for releasably retaining the valve element in a position to close the flow port.

This aspect of the present invention is useful in many situations, including use as a bypass tool, but also as a "dump sub", that is as an element of a drill string, typically located towards the distal end of the string, close to the BHA, which may be opened to permit fluid to drain from the string as the string is withdrawn from the bore.

The tool may further comprise release means for releasing said valve element retaining means. In one embodiment, the release means comprises a flow restriction across which a differential pressure may be developed, the resulting force being utilised to release the valve element retaining means. In one embodiment, the flow restriction is provided in a unit that may be located in the tool only when it is desired to release the valve element retaining means.

Preferably, the valve arrangement includes control means for at least one of controlling the sequence of operation of the valve arrangement and controlling the response of the valve arrangement to actuation forces. The control means may comprise a cam arrangement between the valve element and the body, and may comprise a cam arrangement between a valve actuator and the valve element.

According to a further aspect of the present invention there is provided a fluid-actuated tool comprising:

a body comprising a valve arrangement including at least one flow port in a wall of the body and whereby the port may be selectively opened and closed; and a flow restriction operatively associated with the valve arrangement and upstream of the at least one flow port whereby fluid flow through the restriction creates a valve-actuating force and whereby the flow restriction has a variable, flow-related configuration.

In use, the provision of a flow restriction having a flow-related configuration offers many advantages. In particular, at lower flow rates it may be necessary or desirable to have a tight or narrow restriction, in order to achieve the differential pressure force across the restriction necessary to operate the valve to, for example, open the port. However, once the port is open it may then be possible to increase the flow rate. If the increase in flow rate is accompanied by an increase in the flow area of the restriction the port opening force may be maintained while the losses created by the restriction are minimised. In certain embodiments it may be possible to selectively isolate the valve arrangement from the restriction, such that at higher flow rates the restriction may open up, without affecting the valve configuration; in particular, the port may remain closed at higher flow rates. This is of particular advantage in downhole bypass tools, where difficulties in circulating drilling fluid may be the result, or cause, of low fluid circulating flow rates. However, if the bypass tool is provided with a particularly tight fixed flow restriction this will only exacerbate the problem during normal operations when the bypass tool remains closed, due to the high level of losses induced by the restriction. Furthermore, while a tight nozzle will have a significant effect when the bypass tool is closed, due to the exponential increase in losses with increasing flow rate, the presence of such a tight fixed flow restriction will have a far greater effect when bypassing and pumping faster.

Preferably, the tool is a downhole tool, though embodiments of the invention may find application in surface or sub-sea applications.

Preferably, the tool is a bypass tool, though embodiments of the invention may find application in other tools, such as chemical injection tools.

Preferably, the valve arrangement may be selectively isolated from the flow restriction such that flow through the restriction does not impact on the valve configuration. This is useful in circumstances where it is not necessary or desirable to open or close the port, such that an operator may vary the flow rate through the restriction in the knowledge that such flow rate variations will not inadvertently open the port. Preferably, the means for selectively isolating the valve arrangement from the flow restriction is flow actuated. In a downhole application, this allows an operator to control the means from surface simply by varying the pump rate, for example by increasing or decreasing the pump flow rate, or simply by turning the pumps on and off. The means may take any appropriate form, at the simplest level providing means for releasably retaining the valve arrangement in an initial configuration. Such means may include shear or sprung pins. In preferred arrangements however, means are provided for controlling the interaction between the restriction and the valve arrangement, for example by providing a cam arrangement or providing a J-slot arrangement, such that the means may be cycled between different configurations. In a preferred arrangement, the means is arranged such that it may be continuously cycled, for example by providing a 360-degree or otherwise continuous slot and follower pin.

The flow restriction may take any appropriate form, and is preferably in the form of a nozzle or choke. Preferably, the configuration of the restriction is variable by changing the flow area defined by the restriction in response to flow-related forces experienced by the restriction. Preferably, the restriction normally defines a smaller flow area, which may be zero; in this case there is normally no flow through the restriction. The restriction may be spring biased towards this smaller flow area configuration; a given flow rate will create a greater differential pressure force across the restriction in this configuration. On experiencing a pressure differential force above a predetermined level the restriction may be reconfigured to define a larger flow area, and thus present less of an impediment to flow. This may be achieved by mounting part of the restriction on a spring, such that the part moves when the differential pressure force acting on the part overcomes the spring force. Movement of the part may be damped, for example by locating the spring in a chamber which changes volume as the part moves, and controlling the rate of flow of fluid from or into the chamber.

Preferably, the flow restriction comprises at least two relatively movable parts, the parts being movable to vary the degree of restriction. In one embodiment, the restriction comprises an orifice and a spear, the orifice being axially movable relative to the spear to vary the area of the annulus between the spear and the orifice.

The flow restriction may be integral with the tool body. Alternatively, the flow restriction may be provided as a separate unit and may be located in the tool body as and when required, for example in a somewhat similar manner to the sleeve as described in applicant's WO 01/06086. Thus, the tool body may be provided in, for example, a drill string and remain dormant, presenting little or no restriction to fluid flow, until required. The restriction, which may take the form of a sleeve incorporating a variable orifice, may then be pumped from surface through the string to land on and engage with the body. If desired, the restriction may also be retrievable.

Preferably, the valve arrangement comprises a sleeve, which is one or both of axially and rotatably movable relative to a body wall portion. One or both of the sleeve or body wall may define the one or more flow ports. The sleeve may be biased towards a position to close the ports, or may be biased towards a position to open the ports. Preferably, the sleeve is mounted internally of the body. Seals may be provided between the sleeve and the body, to limit or prevent flow of fluid through the ports when the sleeve is positioned to close the ports. The seals may take a conventional form, for example seal members in the form of elastomer O-rings or chevron seals. Although reference is made herein primarily to bypass tools and the like it will be apparent to those of skill in the art that the various aspects of the invention have application in other tools and devices. In particular, in a further aspect of the invention there is provided a tool comprising a body including a fluid actuated device including a flow restriction whereby fluid flow through the restriction creates an actuating force and whereby the flow restriction has a variable, flow-related configuration.

BRIEF DESCRIPTION OF THE DRAWINGS

These and other aspects of the present invention will now be described, by way of example, with reference to the accompanying drawings, in which:

FIG. 7*a* is a sectional view of the bypass tool of FIG. 4*a*, showing the bypass tool in a second closed configuration;

FIG. 7*b* is a development of the cam arrangement of the bypass tool of FIG. 7*a;*

FIG. 11*a* is a sectional view of a bypass tool in accordance with an embodiment of the invention, shown in an initial locked closed configuration;

FIG. 11*b* is a development of a cam arrangement for controlling the interaction between a flow restriction and a valve arrangement of the tool of FIG. 11*a;*

FIG. 14*a* is a sectional view of the bypass tool of FIG. 11*a*, shown in a second open configuration;

FIG. 14*b* is a development of the cam arrangement of the bypass tool of FIG. 14*a;*

FIG. 15*a* is a sectional view of the bypass tool of FIG. 11*a*, shown in a third open configuration;

FIG. 15*b* is a development of the cam arrangement of the bypass tool of FIG. 15*a;*

FIG. 16*a* is a sectional view of the bypass tool of FIG. 11*a*, shown in a second closed configuration;

FIG. 16*b* is a development of the cam arrangement of the bypass tool of FIG. 16*a;*

DETAILED DESCRIPTION OF THE DRAWINGS

Figure 1:
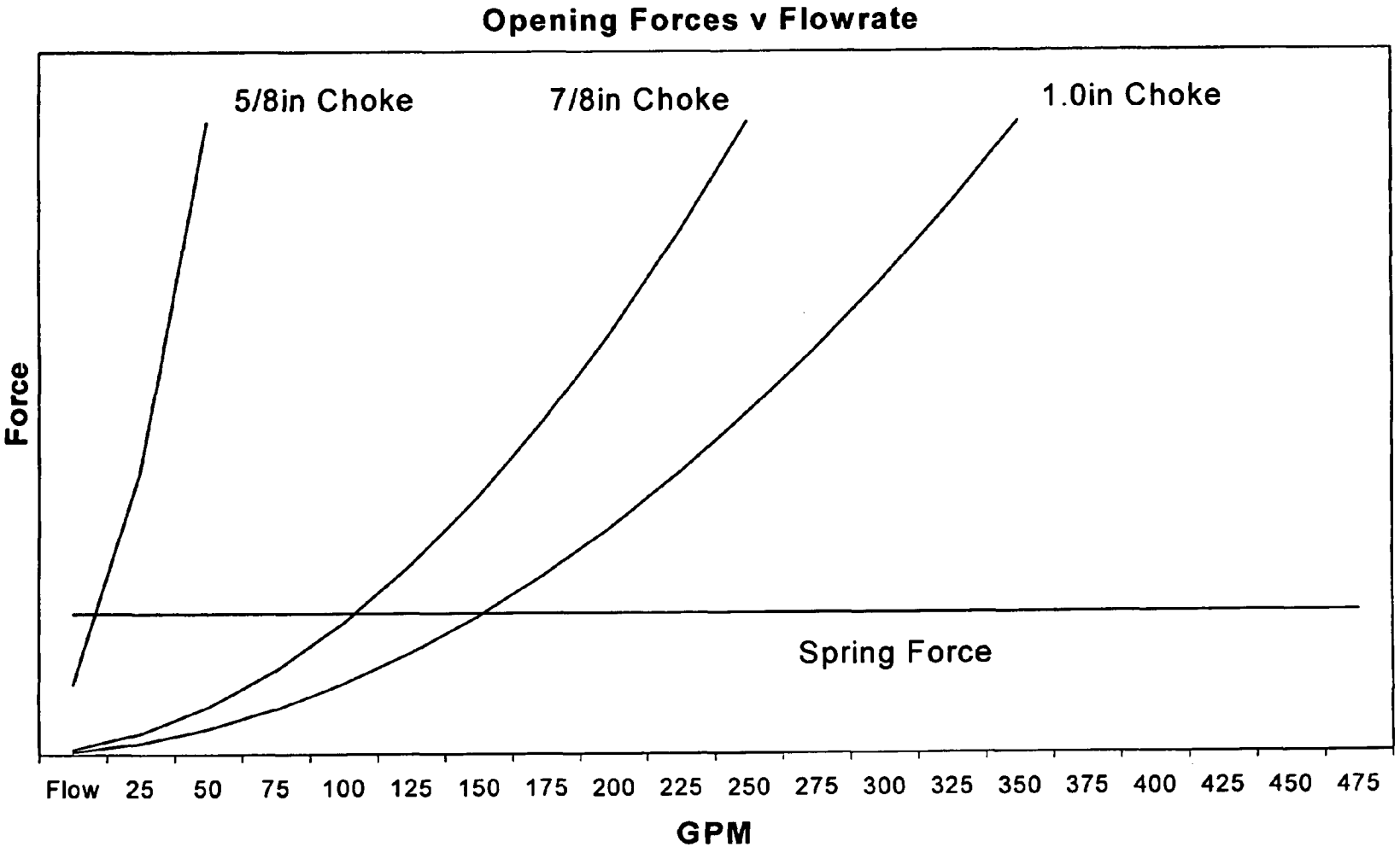
FIGS. 1-3 are graphs illustrating opening forces produced by chokes of different sizes in conventional flow activated bypass tools.

Reference is first made to FIG. 1 of the drawings, which is a graph showing the conventional understanding of opening forces in a downhole bypass tool. In particular, the tool features a sleeve provided in combination with a choke, this sleeve being normally spring biased to close flow ports in the tool body wall. By increasing the flow rate through the choke, the differential pressure force developed across the choke may be increased, and when this force is higher than the spring force provided by the return spring the sleeve will move and open the flow ports.

Conventionally, a tool designer will simply choose the largest choke or nozzle which will open the tool at the desired flow rate, based on the information as portrayed in FIG. 1. However, the present applicant has identified that this is a gross oversimplification of bypass tool operation.

Seals are provided between the sleeve and tool body, and these seals are energised by pressure; the higher the pressure the harder the seals will grip the mating surfaces, thus preventing leakage. However, the harder the seals grip, the more friction increases to prevent relative movement.

Figure 2:
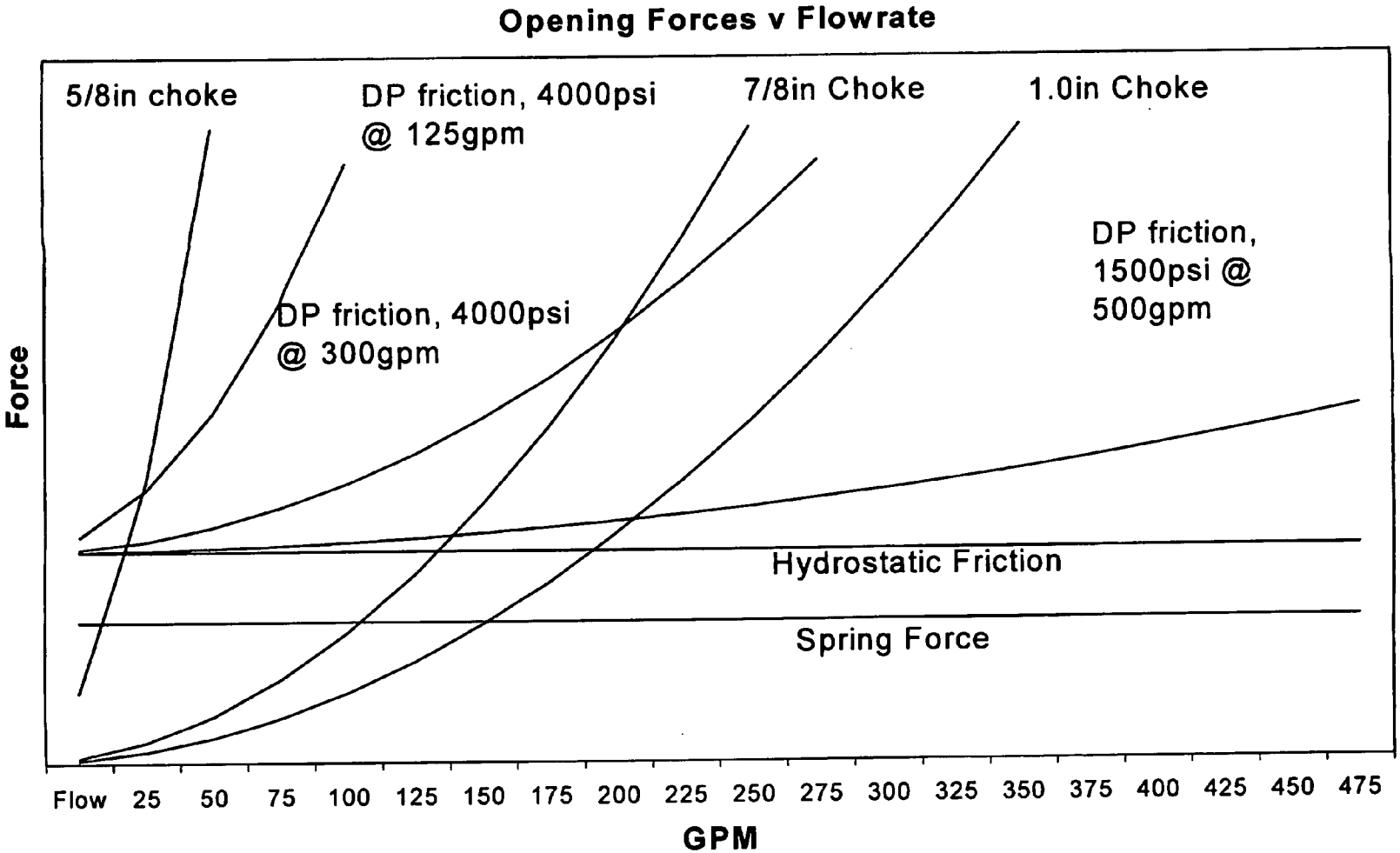

Seals in downhole tools experience both hydrostatic and differential pressure. As may be seen from the graph of FIG. 2, the hydrostatic friction, resulting from the seals being subjected to pressure from the head of fluid standing in the well bore, is constant at a certain depth and mud weight. However, the seal friction due to differential pressure varies exponentially with flow rate. Thus, as may be seen from FIG. 2, at a high differential pressure (4000 psi at 125 gpm) a ⅞ inch choke will never produce sufficient force to open the tool ports.

Accordingly, in order to open the tool ports in a high differential pressure environment, a very tight choke or nozzle is required. This is however self-defeating as at high flow rates a very tight choke results in significant pressure usage; the reason for providing a bypass is to relieve pressure.

Figure 3:
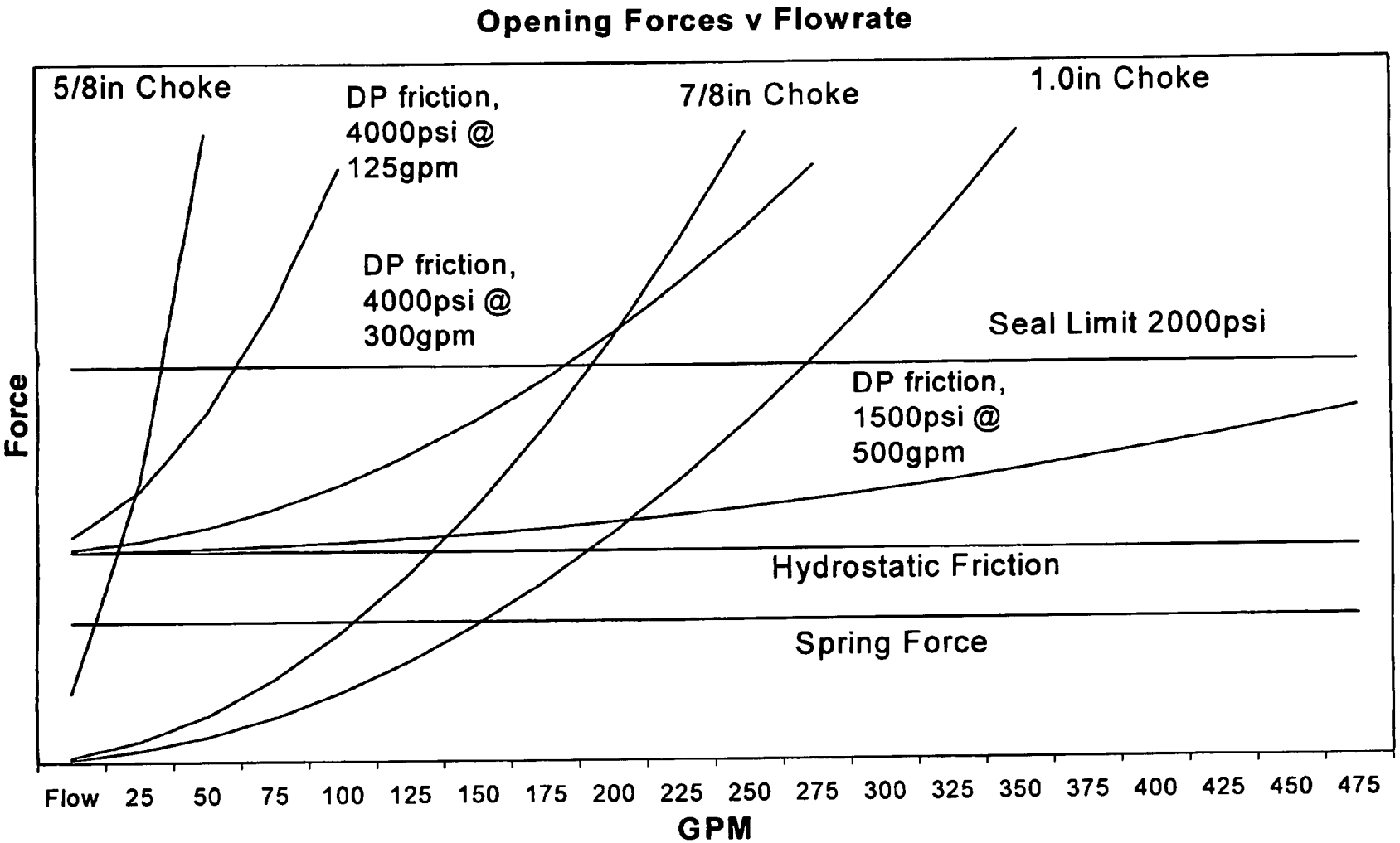

Another issue which must be considered when determining the operating parameters of a flow activated bypass tool is that one of the seals will have a port travel across the seal as the port is opened and closed. As conventional seal members are elastomeric and energised to the point of opening there is a tendency for the seal members to get sucked into the port and sealing function is subsequently lost. Better bypass tools are designed with this in mind, however even the best tools tend to have an upper differential pressure limit of around 2000 psi. As is apparent from the graphs shown in FIG. 3, there remains the possibility of seal failure by this mechanism in certain circumstances.

From the above it is apparent that high differential pressures create a number of technical difficulties for the successful and reliable operation of a flow activated bypass tool.

As noted above, one of the main reasons for using a bypass tool is to relieve pressure, in particular to avoid the pressure losses incurred in pumping the drilling fluid through the BHA, in order to increase the flow rate in the upper annulus, which is often of a larger cross sectional area. In circumstances where there is a large differential pressure prior to opening the bypass tool, the available flow rate is usually low, thus the available opening force is correspondingly low.

Thus, the greater the need for the bypass tool to open, the less force available to open the tool and the greater the frictional resistance to opening. Various aspects of the present invention are intended to address these difficulties, as described below.

Figure 4A:
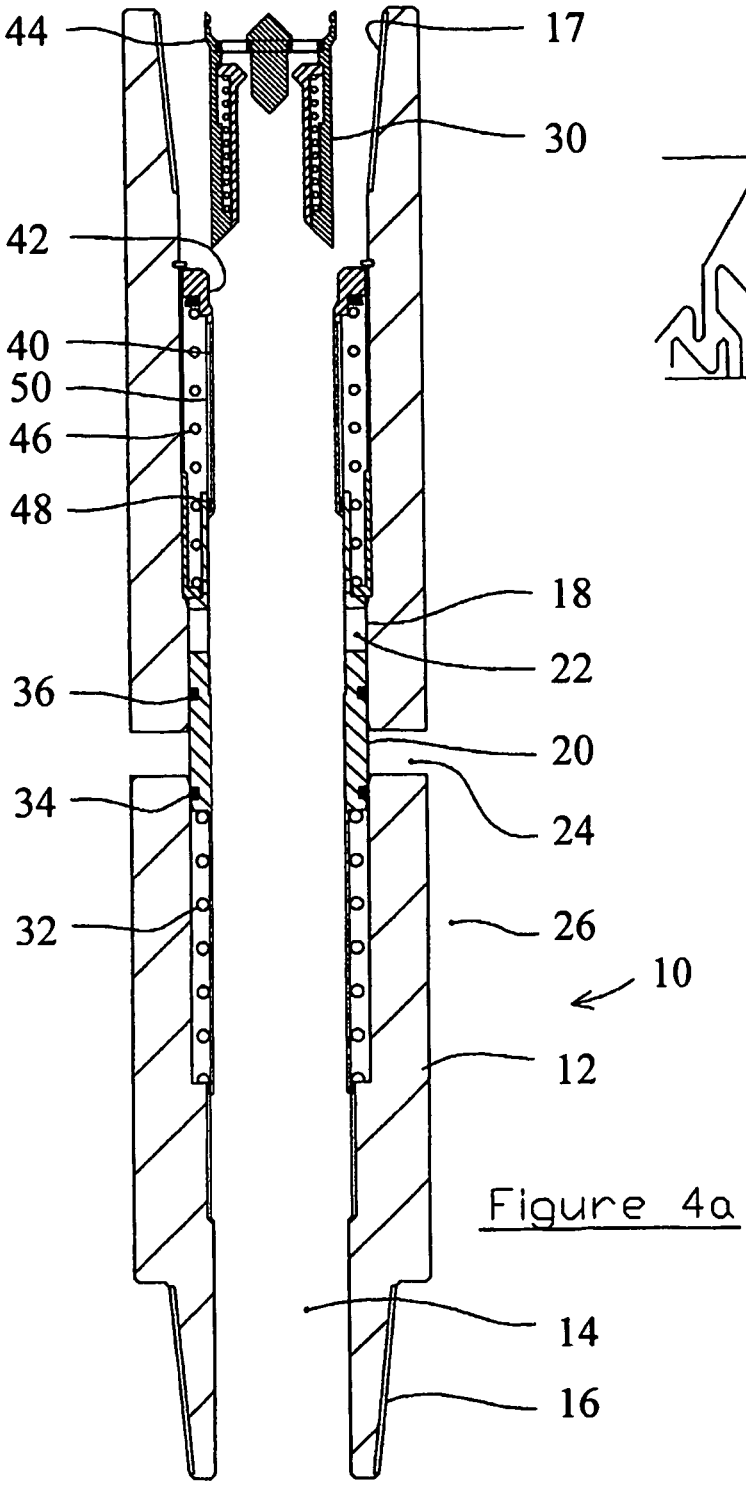
FIG. 4*a* is a sectional view of a bypass tool in accordance with an embodiment of the present invention, shown in an initial closed configuration.

Reference is now made to FIG. 4*a* of the drawings, which is a sectional view of a bypass tool in accordance with a preferred embodiment of the present invention. The tool 10 comprises a generally cylindrical body 12 defining an axial through bore 14. The body 12 is adapted to form part of an otherwise conventional drill string and thus features pin and box ends 16, 17 to allow coupling to adjacent pipe sections. Provided within the body 12 is a valve arrangement 18 including a valve sleeve 20. As will be described, flow ports 22 in the sleeve 20 may be aligned with flow ports 24 in the body 12 to allow drilling fluid to flow directly from the tool bore 14 into the annulus 26 which, in use, will be defined between the exterior of the tool 10 and the surrounding bore wall.

The tool is flow activated by means of a flow restriction 30. The tool body 12 may initially be provided in a drill pipe string without the flow restriction 30, such that there is no impediment to flow of drilling fluid through tool 10. However, when bypass is required, the flow restriction 30 may be pumped down to the tool 10 from surface, and FIG. 4*a* shows the flow restriction 30 just before it engages with the tool body 12.

The valve sleeve 20 is normally biased to an upper position, as illustrated in FIG. 4*a*, by a compression spring 32. In this position, the wall of the sleeve 20 bridges the flow ports 24. Conventional O-ring seals 34 and 36 are provided on the exterior of the sleeve 20 for location below the flow ports 24.

Figure 4B:
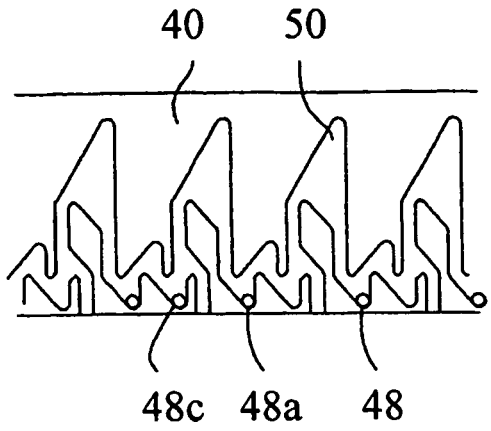
FIG. 4*b* is a development of a cam arrangement for controlling the interaction between a flow restriction and a valve arrangement of the bypass tool of FIG. 4*a;*

The upper end of the sleeve 20 co-operates with a restriction landing sleeve 40 having a profile 42 adapted to engage with a corresponding profile 44 provided on the upper end of the flow restriction 30. The landing sleeve 40 is biased towards an upper position relative to the body 12 by a further compression spring 46. The two sleeves 20, 40 interact via a track and pin arrangement, a development of which is illustrated in FIG. 4*b* of the drawings. In particular, the upper end of the sleeve 20 features a number of radial inwardly directed pins 48 which engage with a continuous cam track 50 formed on an outer surface of the landing sleeve 40.

Figure 4C:
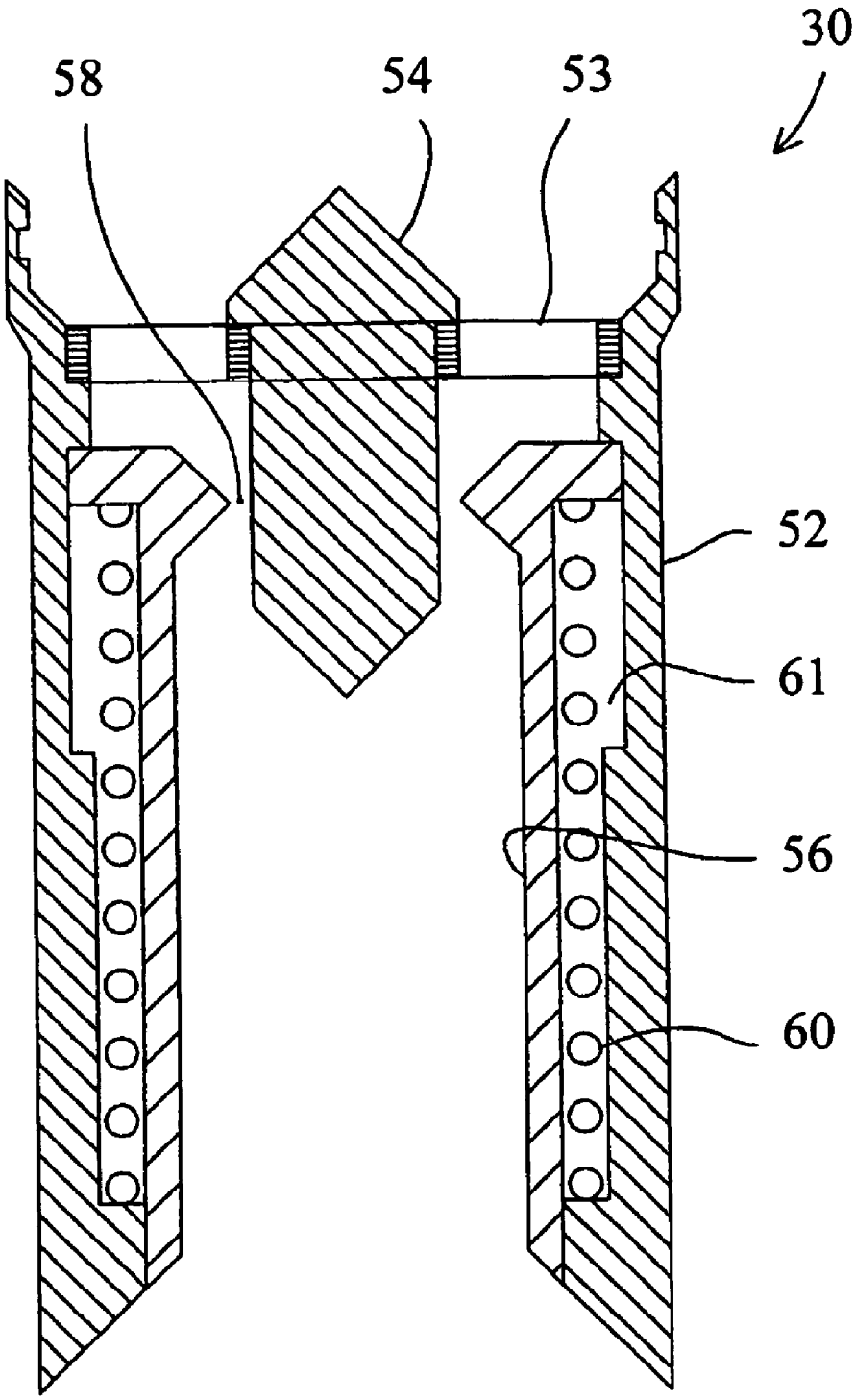
FIG. 4*c* is an enlarged sectional view of the flow restriction of FIG. 4*a;*

Reference is now also made to FIG. 4*c* of the drawings, which illustrates the flow restriction 30 in greater detail. The flow restriction 30 comprises a cylindrical collar 52 that provides mounting for a central spear 54 via an apertured plate 53. Mounted coaxially within the collar 52 is a sleeve 56, the upper end of which defines an orifice 58. A compression spring 60 acts between the sleeve 56 and the collar 52, to bias the sleeve 56 upwardly such that the orifice 58 is positioned around the spear 54. Thus, the flow restriction 30 normally defines a relatively tight choke, the area of the choke being the annulus defined between the orifice 58 and the spear 54.

The spring 60 is located within an annular spring cavity 61. To permit movement of the sleeve 56 relative to the collar 52 it is of course necessary for fluid to be able to pass from and into the cavity 61, as the volume of the cavity 61 changes. However, by providing a relatively small orifice through which fluid must flow from the cavity 61, it is possible to damp the movement of the sleeve 56.

Figures 5A, 5B:
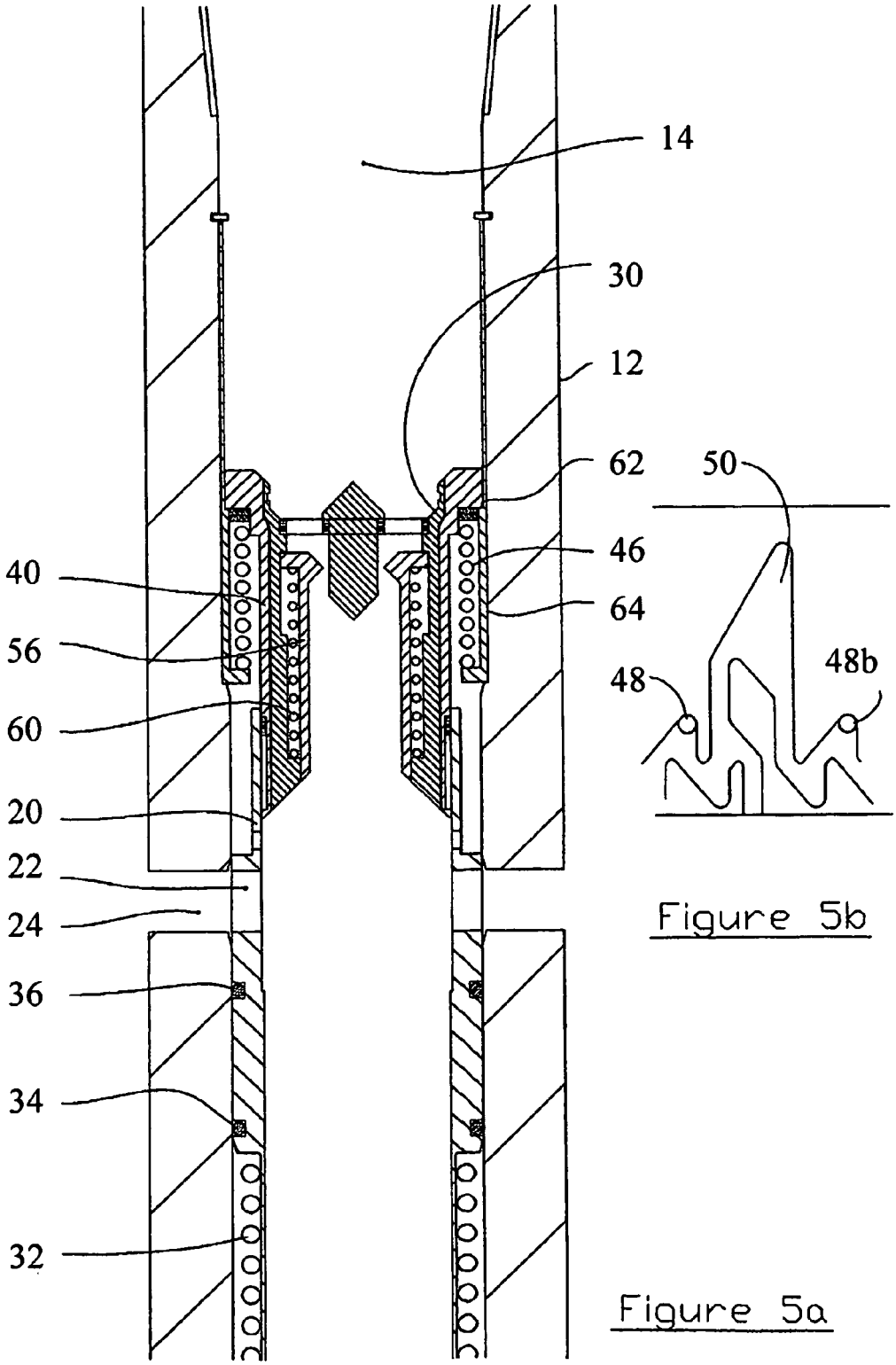
FIG. 5*a* is a sectional view of the bypass tool of FIG. 4*a*, showing the bypass tool open.
FIG. 5*b* is a development of the cam arrangement of the bypass tool of FIG. 5*a;*

As noted above, the tool body 12 will normally be incorporated in a drill string and the flow restriction 30 only pumped into the string when bypass is required. Reference is now made to FIG. 5*a* of the drawings, which shows the flow restriction 30 engaged with the tool body 12. Furthermore, the flow of fluid through the tool bore 14 has created a differential pressure force across the restriction 30. Initial downward movement of the flow restriction 30 induced by this differential pressure force compresses the spring 46 and moves the pins 48 from the initial dormant position 48*a* in the cam track 50 (FIG. 4*b*) to a second position 48*b* where further axial movement of the restriction 30 and landing sleeve 40 produces corresponding movement of the valve sleeve 20, resulting in compression of both springs 32 and 46, and alignment of the flow ports 22, 24. Clearly, such movement of the valve sleeve 20 will only occur when the spring force provided by both springs 32, 46 has been overcome, in addition to the frictional resistance to movement provided by the O-ring seals 34 and 36.

Figure 6A:
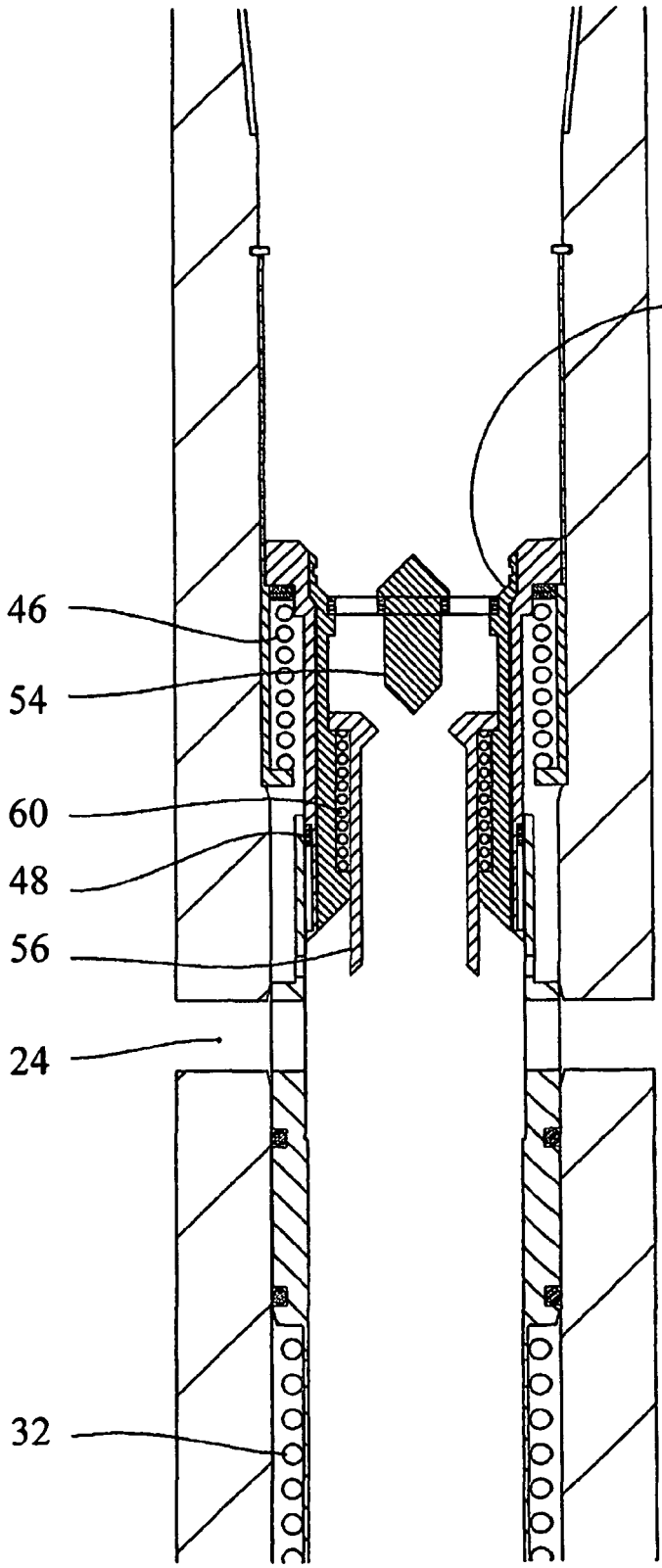
FIG. 6*a* is a sectional view of the bypass tool of FIG. 4*a*, showing the bypass tool in a second open configuration.

If the operator continues to increase the flow rate through the string, the differential pressure force across the restriction 30 will continue to increase. Due to the sleeve 40 landing out on a shoulder 62 of a sleeve 64 fixed to the tool body 12, further axial movement of the sleeves 20, 40 is not possible. However, once the differential pressure force exceeds the orifice closing force provided by the spring 60, the sleeve 56 will be moved downwards to the position illustrated in FIG. 6*a* of the drawings; the spring 60 is selected such that the tool is open before the there is any movement of the sleeve 56. It will be noted that the sleeve 56 has been pushed downwardly beyond the end of the spear 54, such that the restriction to flow provided by the flow restriction 30 has now been considerably reduced. Thus, the pressure losses across the flow restriction 30 will be considerably less than they would have been had the restriction 30 been fixed in the configuration as illustrated in FIGS. 4 and 5.

Figure 6B:
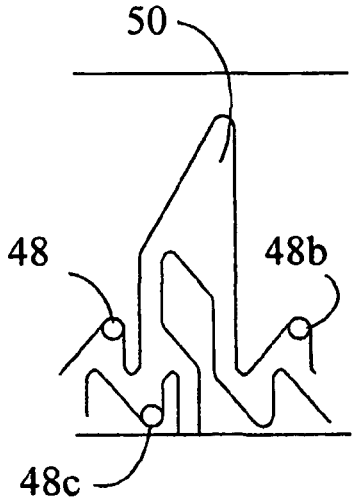
FIG. 6*b* is a development of the cam arrangement of the bypass tool of FIG. 6*a;*

If it is desired to close the flow ports 24 all that is required is for the operator to reduce the drilling fluid flow rate through the string and the tool 10 to the level where the differential pressure force across the flow restriction 30 is less than the return forces provided by the various springs 60, 46 and 32; in practice, this will tend to be achieved by simply turning off the pumps. The sleeves 20, 40 will return to their original positions as illustrated in FIG. 4*a*, however, the follower pins 48 will now be in the position illustrated by numeral 48*c* in the cam track 50, as illustrated in FIG. 6*b*.

If the operator then turns up the drilling fluid pumps once more, the flow restriction 30 together with the landing sleeve 40 will once again be pushed downwardly relative to the tool body 12. However, due to the location of the pins 48 in the cam track 50, the landing sleeve 40 may move downwardly, while the pin 48 moves towards position 48*d* (FIG. 7*b*), without inducing corresponding movement of the valve sleeve 20, until the landing sleeve 40 itself lands out on the shoulder 62. Further increases in drilling fluid flow rate will result in the restriction. sleeve 56 being moved downwards relative to the restriction collar 52, as is illustrated in FIG. 7*a* of the drawings. Accordingly, in this configuration the pressure losses induced by the flow restriction 30 will be substantially less than would have been the case if the flow restriction was fixed in the configuration as illustrated in, for example, FIG. 5*a*.

Figure 8:
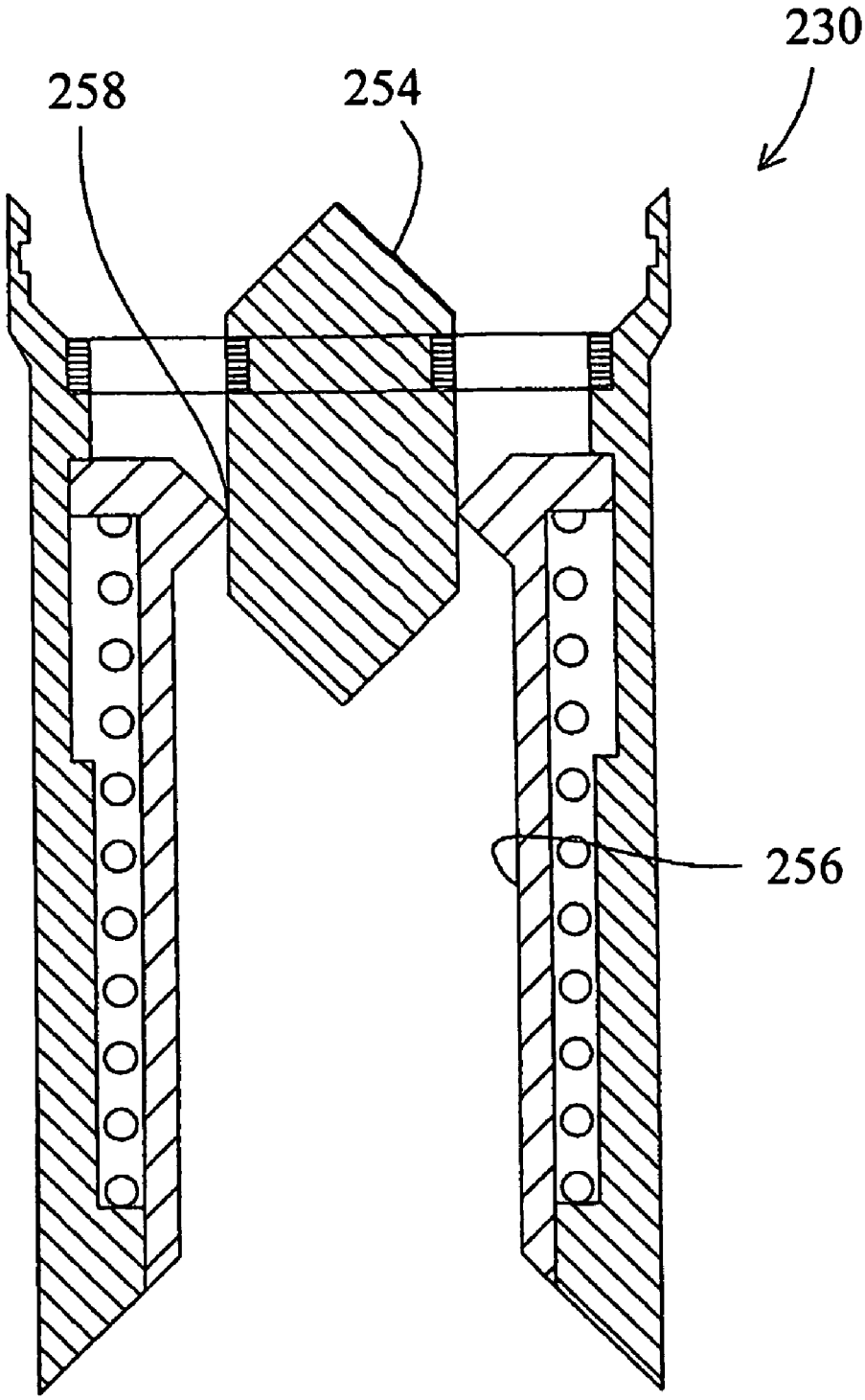
FIGS. 8 and 9 are sectional views of alternative flow restrictions in accordance with further embodiments of the present invention.
Figure 9:
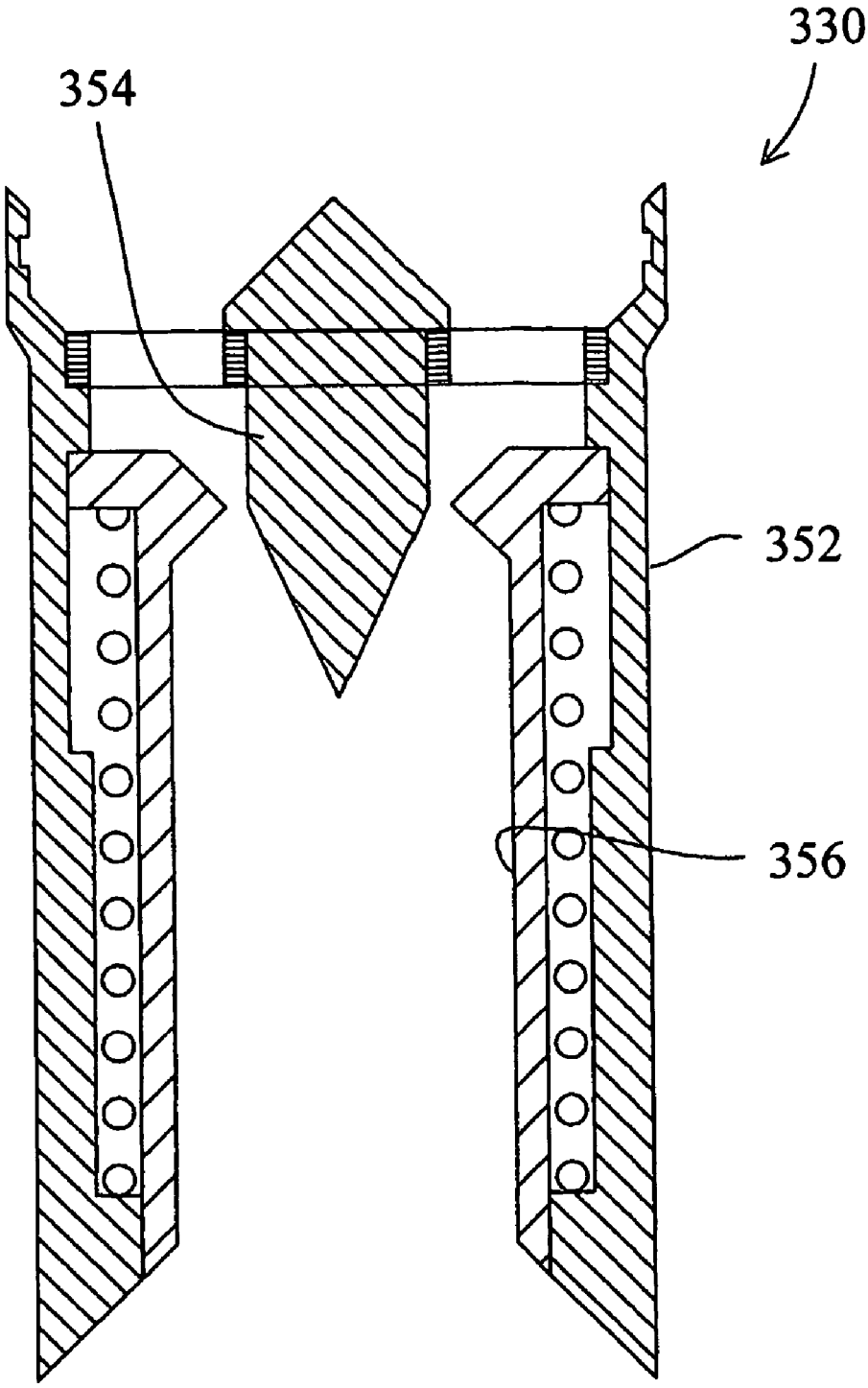

Reference is now made to FIGS. 8 and 9 of the drawings, which illustrate alternative flow restriction forms. In FIG. 8, the flow restriction 230 is configured such that there is normally no flow permitted through the flow restriction, the orifice 258 defined by the upper end of the sleeve 256 being only very slightly larger than the outer diameter of the spear 254. Thus, the flow restriction 230 will initially act as a piston, until the pressure differential across the restriction 230 is sufficient to compress the spring 260 and move the orifice 258 downwards and clear of the spear 254.

In the flow restriction 330 illustrated in FIG. 9, it will be noted that the lower end of the spear 354 is tapered, such that there will be a gradual increase in the choke area as the sleeve 356 is pushed downwards relative to the collar 352.

In the above embodiments the various bypass tools are arranged such that, when the flow ports are open, a significant proportion of fluid flow will pass from the string bore directly into the annulus via the flow ports. A smaller proportion of fluid flow may still pass down through the remainder of the string, through the BHA and the bit, and then pass back up the annulus. This may be useful for a number of reasons, for example for cooling or to keep the mud and cuttings moving to prevent the string getting stuck in the hole. However, in other applications it may be necessary of desirable to prevent flow below the tool, such that all of the fluid is directed through the open flow ports. One situation where this is the case is if a bypass tool is to be used for spotting lost-circulation material (LCM) to the formation without the LCM going through and clogging up the BHA. A number of embodiments of different aspects of the present invention which provide for "100% bypass" are described below.

Figure 10:
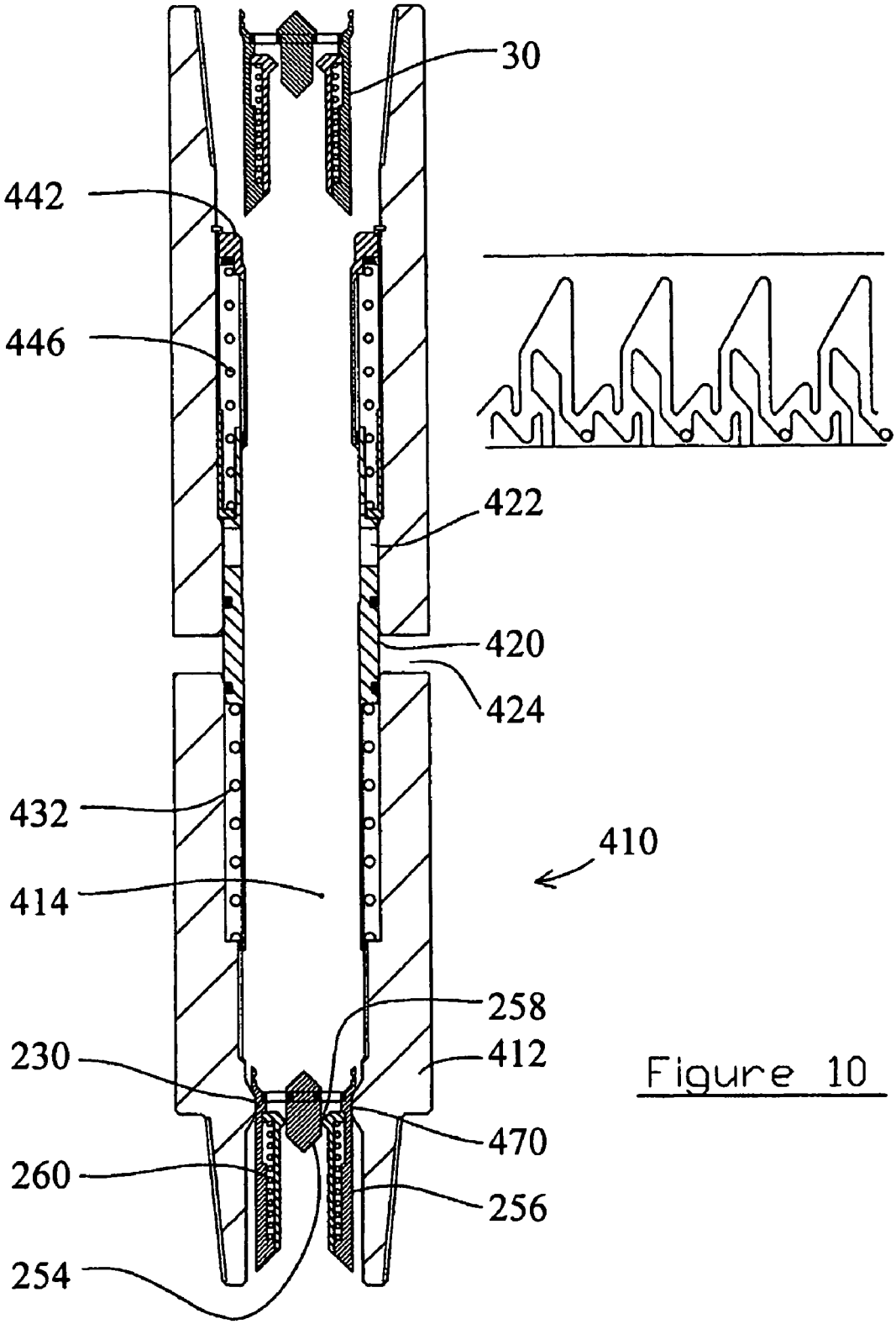
FIG. 10 is a sectional view of a bypass tool in accordance with an embodiment of the invention.
Figure 12:
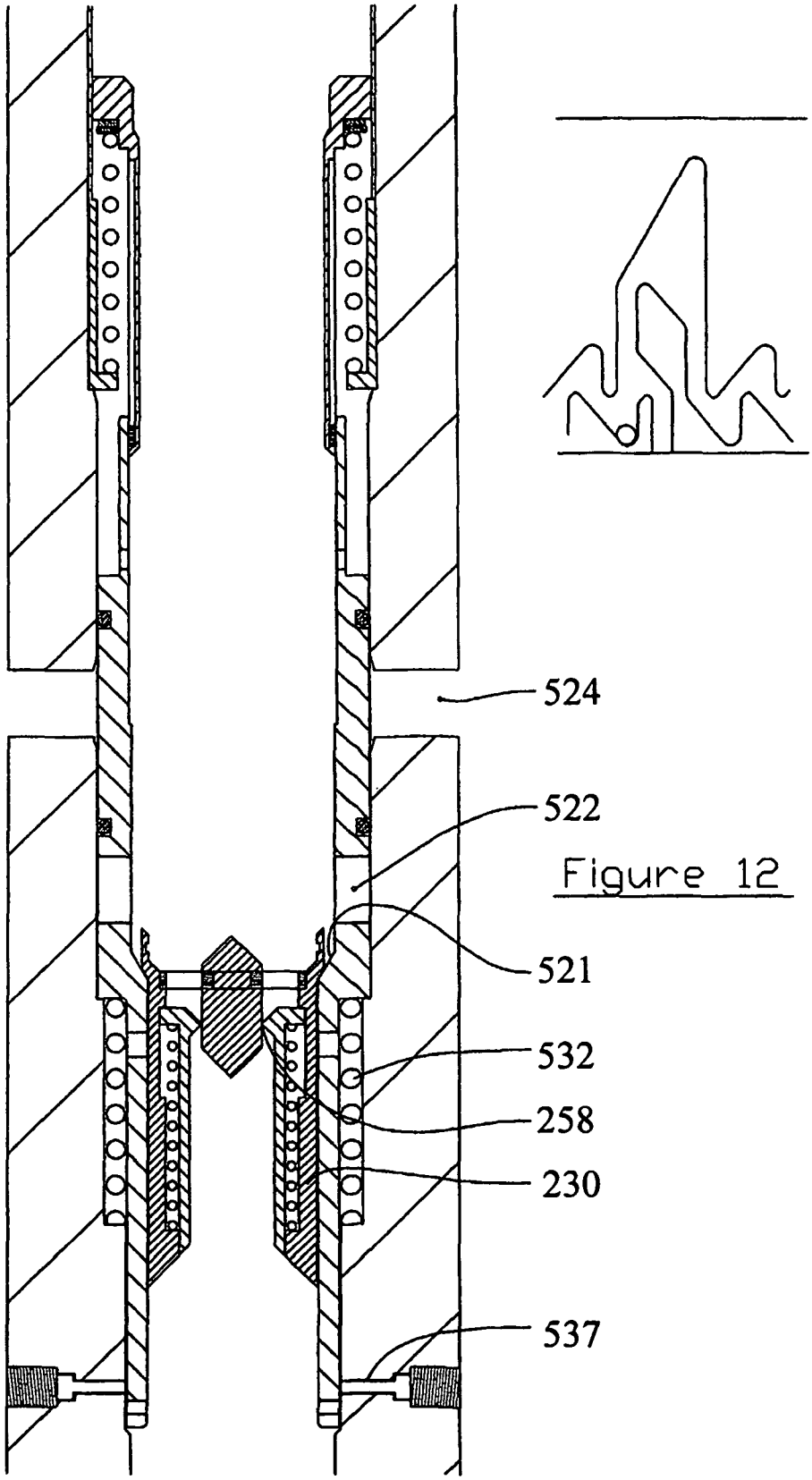
FIG. 12 is a sectional view of the bypass tool of FIG. 11*a*, showing the tool being unlocked, ready to open.

Reference is now made to FIG. 10 of the drawings, which illustrates a tool 410 which is similar in many respects to the tool 10 illustrated in FIG. 4. However, in the tool 410 the tool body 412 features a profile 470 towards the lower end of the tool adapted to engage with a flow-restriction 230, as previously described with reference to FIG. 8. It will be recalled that the flow restriction 230 is configured such that there is normally little or no flow permitted through the flow restriction, the orifice 258 defined by the upper end of the flow restriction sleeve 256 being only very slightly larger than the outer diameter of the spear 254. Thus, the restriction 230 will not permit any significant flow through the tool 410 until the pressure differential across the restriction 230 is sufficient to compress the spring 260 and move the orifice 258 downwards and clear of the spear 254.

In use, the tool 410 is initially held in the closed position by the two main springs 432, 446 and is run into the bore without any restrictions being present within the tool 410. However, when the operator determines that bypass is required, the restriction 230 is pumped down from surface, followed by a second flow restriction 30, as illustrated in FIG. 4*c*. The restriction 30 will land on the profile 470, while the restriction 430 will land on the landing sleeve profile 442.

Significant amounts of drilling fluid will only pass through the tool 410 if the differential pressure across the restriction 230 is sufficient to compress the spring 260 such that the orifice 258 is opened. The flow induced differential pressure forces created by the restriction 30 may then be utilised to move the sleeve 420 to align the flow ports 422, 424 to allow fluid to flow from the tool bore 414 directly into the annulus via the aligned flow ports 422, 424.

As soon as the flow ports 422, 424 are aligned, a significant proportion of the fluid flow will be directed through the ports 422, 424, such that the differential pressure across the lower restriction 230 will drop sharply, such that the spring 260 will tend to move the orifice 258 upwards and around the spear 254, and thus prevent fluid from flowing past the lower restriction 230. Thus, all of the fluid flowing down the string and into the tool 410 will be directed into the annulus via the aligned ports 422, 424.

By varying the fluid flow rate and thus the differential pressure force achieved across the upper restriction 30, the tool may be further manipulated to close the ports 424 and allow fluid to once more pass through the tool 410, past the lower restriction 230 and through the remainder of the string.

If desired, one or both of the restrictions 30, 230 may be retrieved from the string.

Reference is now made to FIGS. 11 through 16 of the drawings, which illustrate the operation of a further bypass tool 510 in accordance with an embodiment of a further aspect of the present invention. Like the tool 410 described above with reference to FIG. 10, the tool 510 illustrated in FIGS. 11 through 16 is intended to provide the possibility of 100% bypass, however the tool operates in a slightly different manner from those embodiments previously described, as set out below.

Reference is first made to FIG. 11*a* of the drawings, which shows the tool 510 in an initial, dormant position. The tool 510 is initially configured such that the flow ports 522, 524 of the tool sleeve 520 and body 512 are misaligned, and any fluid flow through the tool 510 will be directed through the tool bore 514 to the drill string or pipe below the tool. From FIG. 11*a* it will be noted that the initial configuration of the tool 510 is somewhat different from the tools described above, in that the sleeve flow port 522 is positioned below the body flow port 524. Also, it will be noted that the sleeve 520 defines an inner profile 521 and also that the sleeve 520 is initially locked relative to the body 512 by shear pins 537.

Figure 13:
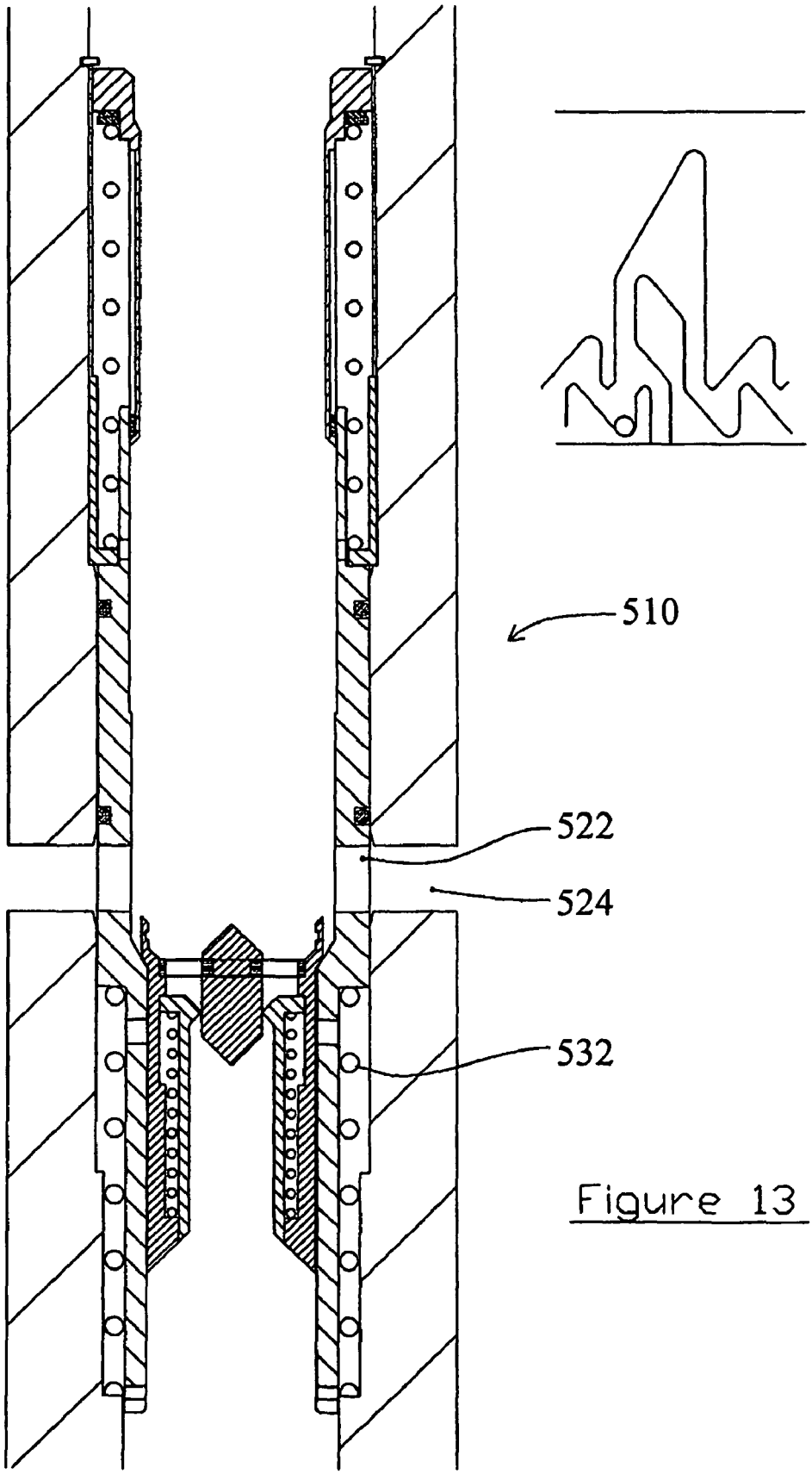
FIG. 13 is a sectional view of the bypass tool of FIG. 11*a*, showing the tool in a first open configuration.

To open the tool 510, a restriction 230 is pumped from the surface down through the string to engage the profile 521. The resulting hydraulic shock will shear the pins 537 (FIG. 12) as the restriction 230 lands. Immediately afterwards the orifice 258 will move down, allowing flow through the restriction 230, while maintaining the flow ports 522, 524 closed (this particular tool configuration not illustrated in the drawings). Subsequently turning off the flow allows the spring 532 to move the sleeve 520 upwardly to align the flow ports 522, 524, as illustrated in FIG. 13 of the drawings. In this configuration, all of the fluid flowing down into the tool 510 will be directed into the annulus via the ports 522, 524, the restriction 230 preventing any significant fluid from flowing past the tool 510 and into the string bore below the tool.

In tool 410 (FIG. 10) the flow restriction 230 is some way below the ports 422. The tools proposed by Pia et al (U.S. Pat. No. 5,890,540) and MacDonald (U.S. Pat. No. 5,901,796) also have this arrangement. However, this has a major disadvantage if it is required to spot LCM; a volume of LCM will settle in this area and not go out of the side ports. Later, this volume of LCM will get pumped through the BHA, which is exactly the situation a LCM tool should avoid. By contrast the position of the restriction 230 in tool 510 is just below the ports 522, allowing all the LCM to be flushed out of the side ports and plug up gaps in the rock formation and not plug up the BHA.

If it is desired to close the flow ports 524, a further restriction 530 is pumped down the string from surface to engage with the sleeve profile 524, as illustrated in FIG. 14*a* of the drawings. The restriction 530 is similar to the restriction 30 described above with reference to FIG. 4*c*, and includes a sleeve 556 which is biased to co-operate with a spear 554 to define a tight choke 558 (see FIG. 15*a*). However, on experiencing an elevated differential fluid pressure force, induced by an increased flow rate, the sleeve 556 may be moved clear of the spear 554, and the restriction 530 is illustrated in this configuration in FIG. 14*a*.

As with the above described embodiments, the tool 510 includes a landing sleeve 540 defining a cam track 550 which co-operates with cam pins 548 on the cam track 550 on the valve sleeve 520. From an initial pin position 548*a* on the cam track 550 (see FIG. 11*b*), an elevated fluid flow rate through the string will cause the landing sleeve spring 546 to compress such that the pin 548 moves towards a second position 548*b* on the track 550, and the landing sleeve 540 comes to rest against the body shoulder 562. The restriction 530 will then open. Thus, in this configuration, as illustrated in FIG. 14*a*, the differential pressure force created by the flow restriction 530 has no impact on the position of the sleeve 520. However, if the pumps at surface are shut down for a short period, the restriction 530 and the landing sleeve 540 will move towards the position as illustrated in FIG. 15*a* of the drawings, while the cam track 550 will cause the landing sleeve 540 to rotate as it moves axially upwards such that the cam pins 548 on the valve sleeve 520 will move to position 548*c* on the track 550, as illustrated in FIG. 15*b* of the drawings. If the pumps are turned on once more, the resulting differential pressure across the restriction 530 will compress the landing sleeve spring 546. Also, from the pin position 548*c*, the valve sleeve pins 548 will move to a position 548*d* in the cam track 550 (see FIG. 16*b*), such that the differential pressure force, created across the restriction 530, will be applied to the sleeve 520, and will tend to move the sleeve 520 to close the flow ports 524.

Furthermore, as the flow ports 524 are closed a differential pressure will tend to develop across the lower restriction 230, producing a further pressure differential force tending to move the valve sleeve 520 downwardly, until ultimately the flow ports 524 will be completely closed and the lower restriction 230 will open. As the flow is increased further the restriction 530 opens, as illustrated in FIG. 16*a* of the drawings; the tool 510 is thus now configured such that all of the fluid flowing down through the string passes through the tool 510 into the string bore below the tool.

Figure 17:
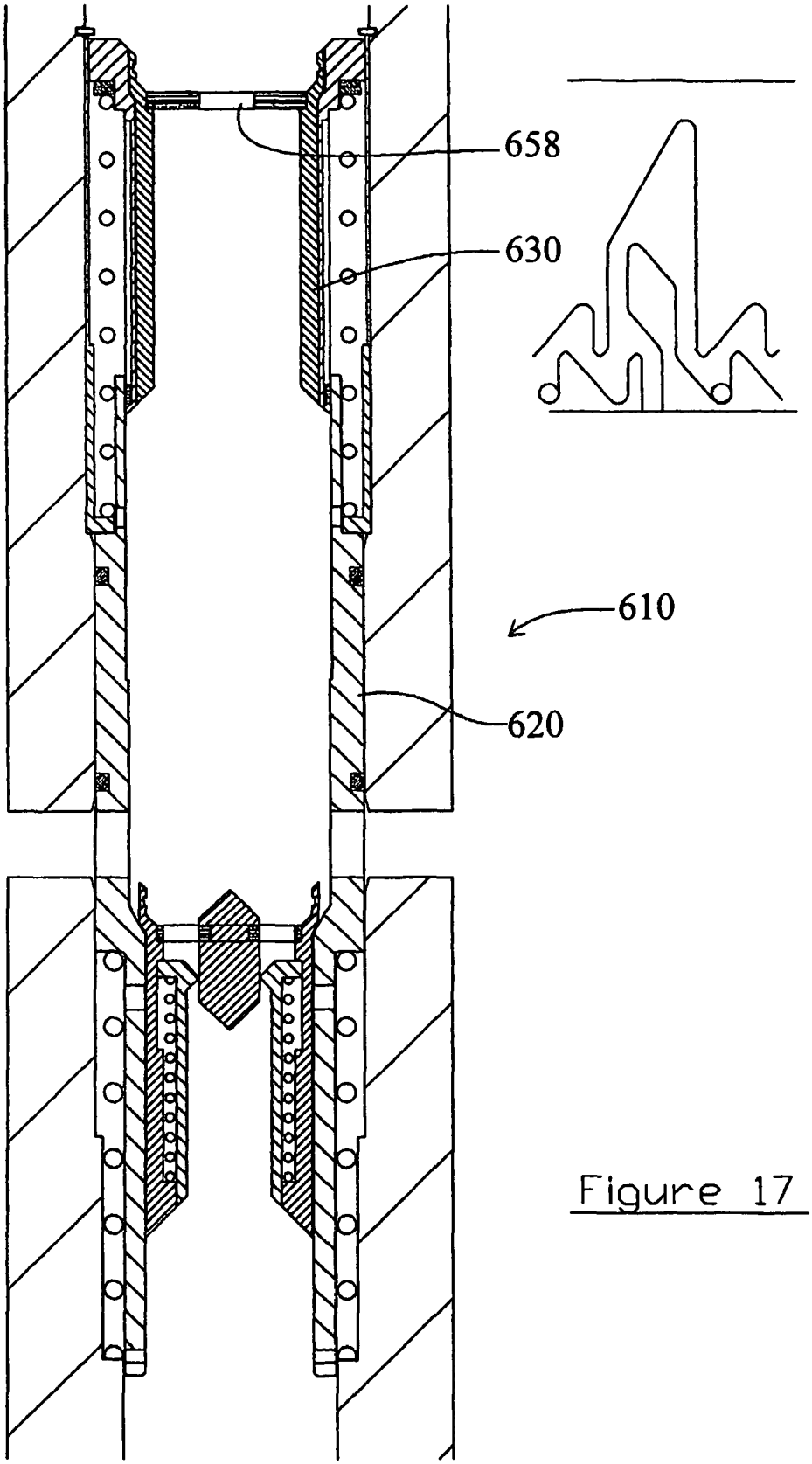
FIG. 17 is a sectional view of a bypass tool in accordance with an embodiment of the invention.

Reference is now made to FIG. 17 of the drawings, which illustrates a tool 610 in accordance with another embodiment of the present invention. The tool 610 is similar to the tool 510 described above, with the exception that the upper second restriction 630 features a fixed diameter choke 658. This tool 610 will operate in substantially the same manner as the tool 510, however the energy losses induced by the restriction 630 will tend to be slightly higher than the losses induced by the variable restriction 530.

Davy et al (WO 9630621), Pia et al (U.S. Pat. No. 5,890,540) and MacDonald (U.S. Pat. No. 5,901,796) all disclose flow activated bypass tools which are configured to selectively bypass and seal off the through bore below the bypass ports. By contrast, the tools 410, 510 and 610 made in accordance with embodiments of the present invention do substantially block off the through bore of the tools below the ports but they do not seal the bore (although the restriction 230 could be configured to create a seal if desired). This is important in tools 510 and 610 when opening the ports by turning the flow off; the pressure differential across the restriction 230 must be allowed to equalise to ensure the sleeves 520 and 620 are not prevented from moving upwards to open the side ports.

In addition to their utility as bypass subs, the tools 510 and 610 are likely to prove useful as "dump subs", that is subs that are included in a drill string only a short distance above the BHA, and that can be opened just before the drill string is pulled out of the hole. As the string is lifted and disassembled on surface, drilling fluid within the string bore may drain from the string bore and into the well via the open flow ports.

Those of skill in the art will recognise that the above described embodiments of the present invention overcome many of the significant problems faced by conventional flow activated tools, and it is anticipated that bypass tools and other tools made in accordance with embodiments of the present invention may be capable of operating under a wide range of hydrostatic and differential pressures and available flow rates, without using up too much pressure. The tools will also be able to effectively prevent flow onward through the string while bypassing and particularly prevent LCM from getting to the BHA.

Those of skill in the art will also recognise that the above described embodiments are merely exemplary of the present invention, and that various modifications and improvements may be made thereto without departing from the scope of the present invention. For example, in other embodiments the valve sleeve may be coupled to the body via a cam arrangement, to provided greater control of the movement of the sleeve, and this would permit, for example, the "normally-open" tools 510 and 610 to be maintained in a closed configuration in the absence of flow.

The invention claimed is:

1. A downhole tool comprising:

a body adapted to be incorporated in a string of tubing for carrying fluid from surface towards a distal end of the string, the body defining a bore and comprising a valve arrangement including at least one flow port in the wall of the body and whereby the port may be selectively opened and sealed closed; and a variable flow restriction in the bore responsive to flow from surface towards the distal end of the string through the tubing, the degree of restriction tending to decrease as flow across the restriction increases, wherein the variable flow restriction is adapted to create a pressure differential and the resulting force utilised to actuate the valve arrangement, and wherein the variable flow restriction is positioned upstream of the flow port.

2. The tool of claim 1, wherein the valve arrangement is biased towards an open configuration.

3. The tool of claim 1, wherein valve arrangement is biased towards a closed configuration.

4. The tool of claim 1, wherein the valve arrangement is initially retained in one of an open configuration and a closed configuration.

5. The tool of claim 4, wherein after release from the initial configuration the valve arrangement tends to move to the other configuration.

6. The tool of claim 1, wherein the valve arrangement includes control means for at least one of controlling the sequence of operation of the valve arrangement and controlling the response of the valve arrangement to actuation forces.

7. The tool of claim 1, wherein the valve arrangement is adapted to be actuated by a differential fluid pressure acting across at least one flow restriction in the bore.

8. The tool of claim 7, wherein said flow restriction is provided, at least in part, by at least one of:

the variable flow restriction;

further flow restriction; and a combination of the variable flow restriction and the further flow restriction.

9. The tool of claim 8, wherein the further flow restriction is one of a fixed restriction and a variable restriction.

10. The tool of claim 8, wherein the further flow restriction is provided as a separate unit adapted to be selectively located in the body.

11. The tool of claim 8, wherein the further flow restriction is provided above said variable flow restriction.

12. The tool of claim 1, wherein the variable flow restriction features a tight configuration in which the restriction substantially closes the body bore.

13. The tool of claims 12, wherein in the tight configuration the variable flow restriction is configured to permit pressure equalisation thereacross.

14. The tool of claim 1, wherein the variable flow restriction features a tight configuration in which the flow restriction allows flow through the bore.

15. The tool of claim 1, wherein the variable flow restriction is integral with the body.

16. The tool of claim 1, wherein the variable flow restriction is provided as a separate unit adapted to be selectively located in the body.

17. A method of controlling flow between a tubular downhole string and a surrounding annulus, the method comprising:

providing a valve arrangement in a tubular downhole string, the valve arrangement having a flow port providing fluid communication between the string bore and the surrounding annulus and a variable flow restriction positioned upstream of the flow port;

pumping fluid through the string;

utilising the variable flow restriction to create a pressure differential and utilising the resulting force to actuate the valve arrangement selectively configuring the valve arrangement to open the flow port;

selectively configuring the valve arrangement to close the flow port; and increasing the flow rate through the flow restriction to decrease the degree of restriction provided by the flow restriction.

18. The method of claim 17, comprising biasing the valve arrangement such that the port is normally open.

19. The method of claim 17, comprising initially retaining the valve arrangement in one of an open configuration and a closed configuration.

20. The method of claim 17, comprising actuating the valve arrangement by a differential fluid pressure acting across at least one further flow restriction in the bore.

21. The method of claim 20, comprising providing a further flow restriction as a separate unit and dropping the further flow restriction into the body.

22. The method of claim 17, comprising configuring the variable flow restriction to close the body bore.

23. The method of claim 17, comprising utilising the variable flow restriction to direct substantially all of the fluid flowing into the tool through the flow port.

24. A fluid actuated tool comprising:

a body comprising a valve arrangement including at least one flow port in a wall of the body and whereby the port may be selectively opened and closed; and a flow restriction operatively associated with the valve arrangement and upstream of the at least one flow port whereby fluid flow through the restriction creates a valve-actuating force and whereby the flow restriction has a variable, flow-related configuration.

25. The tool of claim 24, wherein the restriction is adapted to reconfigure to define a larger flow area on experiencing a pressure differential force above a predetermined level.

26. The tool of claim 25, wherein part of the restriction is spring-mounted, such that the part moves when the differential pressure force acting on the part overcomes the spring force.

27. The tool of claim 26, wherein movement of the part is damped.

28. A downhole tool comprising:

a body adapted to be incorporated in a string of tubing for carrying fluid from surface towards a distal end of the string, the body defining a bore and comprising a valve arrangement including at least one flow port in the wall of the body and whereby the port may be selectively maintained open and closed; and a variable flow restriction in the bore responsive to flow from surface towards the distal end of the string through the tubing, the degree of restriction tending to decrease as flow across the restriction increases, wherein the variable flow restriction is adapted to create a pressure differential and the resulting force utilised to actuate the valve arrangement and wherein the variable flow restriction is positioned upstream of the flow port.

* * * * *